US010533303B2

(12) United States Patent
Tsuchie et al.

(10) Patent No.: US 10,533,303 B2
(45) Date of Patent: Jan. 14, 2020

(54) CONSTRUCTION MACHINE TO ADJUST OPERATION REACTION FORCE OF AN OPERATING LEVER

(71) Applicant: HITACHI CONSTRUCTION MACHINERY CO., LTD., Tokyo (JP)

(72) Inventors: Yoshiyuki Tsuchie, Tokyo (JP); Hiroshi Sakamoto, Tsuchiura (JP); Hidekazu Moriki, Tokyo (JP); Yasutaka Tsuruga, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 75 days.

(21) Appl. No.: 15/749,828

(22) PCT Filed: Mar. 15, 2016

(86) PCT No.: PCT/JP2016/058082
§ 371 (c)(1),
(2) Date: Feb. 2, 2018

(87) PCT Pub. No.: WO2017/043112
PCT Pub. Date: Mar. 16, 2017

(65) Prior Publication Data

US 2018/0223500 A1 Aug. 9, 2018

(30) Foreign Application Priority Data

Sep. 10, 2015 (JP) ..... 2015-178516

(51) Int. Cl.
*E02F 9/22* (2006.01)
*E02F 9/20* (2006.01)
(Continued)

(52) U.S. Cl.
CPC ..... *E02F 9/2203* (2013.01); *E02F 3/435* (2013.01); *E02F 3/437* (2013.01); *E02F 9/2004* (2013.01);
(Continued)

(58) Field of Classification Search
CPC combination set(s) only.
See application file for complete search history.

(56) References Cited

U.S. PATENT DOCUMENTS 4,776,751 A * 10/1988 Saele ..... E02F 9/2029 414/697
5,816,335 A * 10/1998 Yamamoto ..... E02F 3/845 172/4.5
(Continued)

FOREIGN PATENT DOCUMENTS

JP 09-88112 A 3/1997
JP 10-317417 A 12/1998
(Continued)

OTHER PUBLICATIONS

International Search Report of PCT/JP2016/058082 dated Jun. 7, 2016.

*Primary Examiner* — Thomas G Black
*Assistant Examiner* — Ana D Thomas
(74) *Attorney, Agent, or Firm* — Mattingly & Malur, PC

(57) ABSTRACT

A construction machine includes a control device having a reaction-force correction control section. When a difference between a target operator input and an actual operator input for a front member exceeds a preset range, the reaction-force correction control section executes correction to increase an operation reaction force to be applied by a reaction-force applying device to an operating unit operating an actuator driving the front member. When the difference falls within the range, the reaction-force correction control section executes correction to decrease the operation reaction force
(Continued)

to be applied by the reaction-force applying device to the operating unit operating the actuator driving the front member.

6 Claims, 12 Drawing Sheets

(51) Int. Cl.
*E02F 3/43* (2006.01)
*E02F 3/32* (2006.01)

(52) U.S. Cl.
CPC ..... *E02F 9/2025* (2013.01); *E02F 9/2029* (2013.01); *E02F 9/2271* (2013.01); *E02F 3/32* (2013.01)

(56) References Cited

U.S. PATENT DOCUMENTS

| | | | | | |
|---|---|---|---|---|---|
| 5,950,141 | A * | 9/1999 | Yamamoto | E02F 3/845 | 701/469 |
| 2008/0201045 | A1* | 8/2008 | Kagoshima | E02F 9/123 | 701/50 |
| 2009/0293322 | A1* | 12/2009 | Faivre | G05D 1/0891 | 37/348 |
| 2018/0230671 | A1* | 8/2018 | Wu | E02F 3/437 | |

FOREIGN PATENT DOCUMENTS

| | | | |
|---|---|---|---|
| JP | 2005-320846 | A | 11/2005 |
| JP | 2006-144349 | A | 6/2006 |
| JP | 2007-303128 | A | 11/2007 |

* cited by examiner

CONSTRUCTION MACHINE TO ADJUST OPERATION REACTION FORCE OF AN OPERATING LEVER

TECHNICAL FIELD

The present invention relates to a construction machine.

BACKGROUND ART

Construction machinery is known, such as a hydraulic excavator including a front working device configured with a plurality of front members such as a boom, an arm, a bucket and/or the like, etc. (see Patent Literature 1). The front working device is driven by operation of operating members corresponding to the respective front members. The operating devices of the construction machinery disclosed in Patent Literature 1 includes reaction-force control means that controls reaction-force applying means so that an operation reaction force is applied to each of the operating members as a function of the degree of approach to the boundary of a working range of the front working device by operating each operating member.

The reaction-force control means disclosed in Patent Literature 1 computes, based on an attitude of the front working device and manipulation of each operating member, a distance between the front working device and the boundary of a working range created by operation of each operating member every after a predetermined period of time has elapsed. The reaction-force control means controls the reaction-force applying means to apply an operation reaction force to only the operation of the operating member causing the computed distance to be shorter than the distance between the current position of the front working device and the boundary of the working range.

CITATION LIST

Patent Literature

PATENT LITERATURE 1: JP-A No. 2005-320846

SUMMARY OF INVENTION

Technical Problem

Since the front working device is configured with a plurality of front members, when, for example, the claw edge of the bucket is moved along a linear target trajectory for work such as linear excavation work or the like, the plurality of front members is required to be operated in combination, involving a need of manipulation experience. Moreover, it is not easy for even a skilled operator to carry out high-precision and also high-speed work, and therefore there is a disadvantageous problem that long-duration work causes fatigue, leading to a reduction in work efficiency Patent Literature 1 proposes the use of operation reaction force to assist operators, but this does not arrive to a solution to the above problems.

Solution to Problem

According to an aspect of the present invention, a construction machine includes a front working device having a plurality of front members including at least a first front member and a second front member, a plurality of actuators to drive the plurality of front members, and an operating unit for operating the plurality of actuators. The construction machine further includes a reaction-force applying device that applies an operation reaction force based on an actual operator input to the operating unit, and a control device. The control device has: an operator input detection section that detects an actual operator input of the operating unit in order to generate a control signal for the reaction-force applying device; a trajectory setting section that sets a target trajectory of a preset region of the front working device; a position detection section that detects a position of the preset region of the front working device moving because the plurality of front members drive; a target speed setting section that sets a target speed of the preset region of the front working device to follow the target trajectory; a target operator input setting section that sets a target operator input of each of at least the first front member and the second front member on the basis of the target speed; and a reaction-force correction control section. When a difference between the target operator input and the actual operator input for the front member exceeds a preset range, the reaction-force correction control section executes correction to increase the operation reaction force to be applied by the reaction-force applying device to the operating unit operating the actuator driving the front member, and when a difference between the target operator input and the actual operator input for the front member is within the range, the reaction-force correction control section executes correction to decrease the operation reaction force to be applied by the reaction-force applying device to the operating unit operating the actuator driving the front member.

Advantageous Effects of Invention

According to the present invention, the performance of working along a target trajectory can be facilitated, thus achieving improved work efficiency.

DESCRIPTION OF EMBODIMENTS

Figure 1:
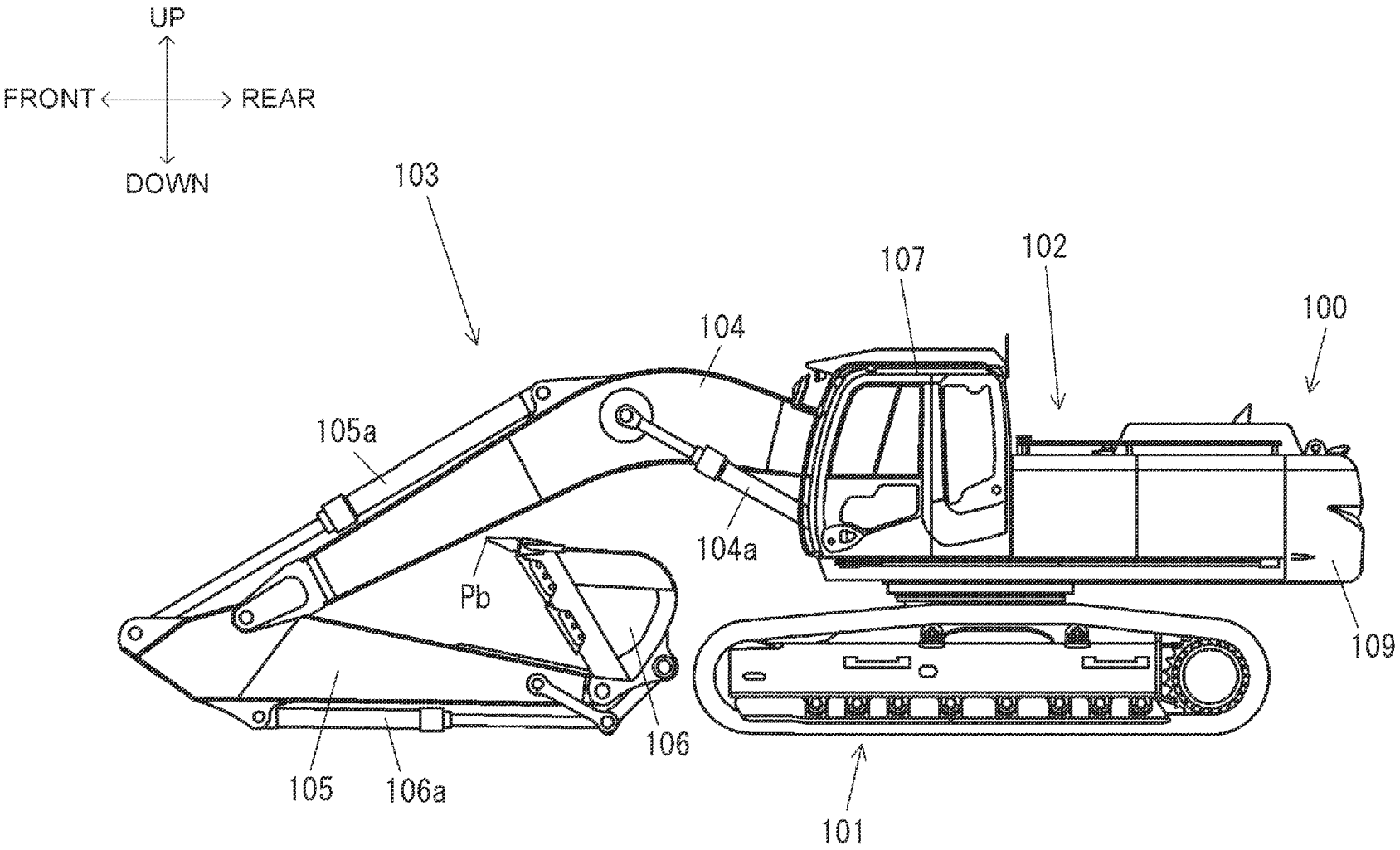
FIG. 1 is a side view of construction machinery to which the embodiment is applied.

FIG. 1 is a side view of a hydraulic excavator (backhoe) 100 which is an example of construction machinery to which the present invention is applied. Incidentally, for convenience in describing, the front, rear, upper and lower dictions are defined as illustrated in FIG. 1. As illustrated in FIG. 1, the hydraulic excavator 100 includes a travel base 101 and a revolving upperstructure 102 mounted on the travel base 101 in a revolvable manner. The travel base 101 travels by a pair of left and right crawlers being driven by a travel motor.

A cab 107 is placed on the front left side of the revolving upperstructure 102, and an engine compartment is placed at the rear of the cab 107. The engine compartment contains an engine serving as a power source, hydraulic equipment, and the like. A counterweight 109 is mounted at the rear of the engine compartment to provide balance of the machine body during operation. A front working device 103 is placed on the front right side of the revolving upperstructure 102.

The front working device 103 includes a plurality of front members, specifically, a boom 104, an arm 105 and a bucket 106. The boom 104 has the proximal end rotatably attached to the front of the revolving upperstructure 102. The arm 105 has one end rotatably attached to the distal end of the boom 104. The boom 104 and the arm 105 are driven to be raised/lowered by a boom cylinder 104*a* and an arm cylinder 105*a*, respectively. The bucket 106 is attached to the distal end of the arm 105 so as to be vertically rotatable relative to the arm 105, and the bucket 106 is driven by a bucket cylinder 106*a*.

Figure 2:
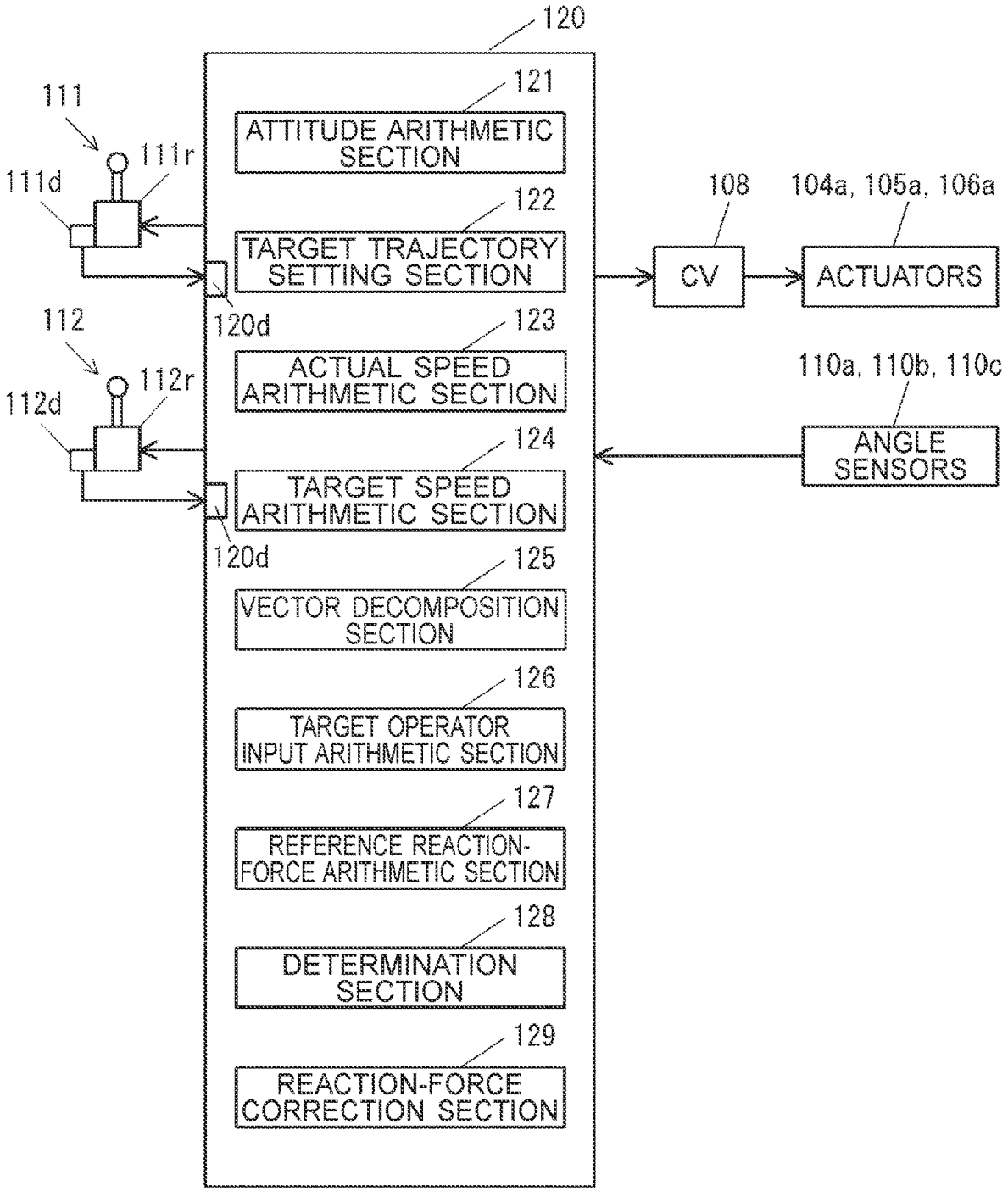
FIG. 2 is a schematic diagram illustrating the configuration of a controller according to the embodiment.

FIG. 2 is a schematic diagram illustrating the configuration of a controller 120 according to the embodiment. The hydraulic excavator 100 includes the controller 120. The controller 120 includes a CPU, a ROM and a RAM which are storage devices, and an arithmetic processor having other peripheral circuits and/or the like, and the controller 120 controls individual components of the hydraulic excavator 100.

Figure 3:
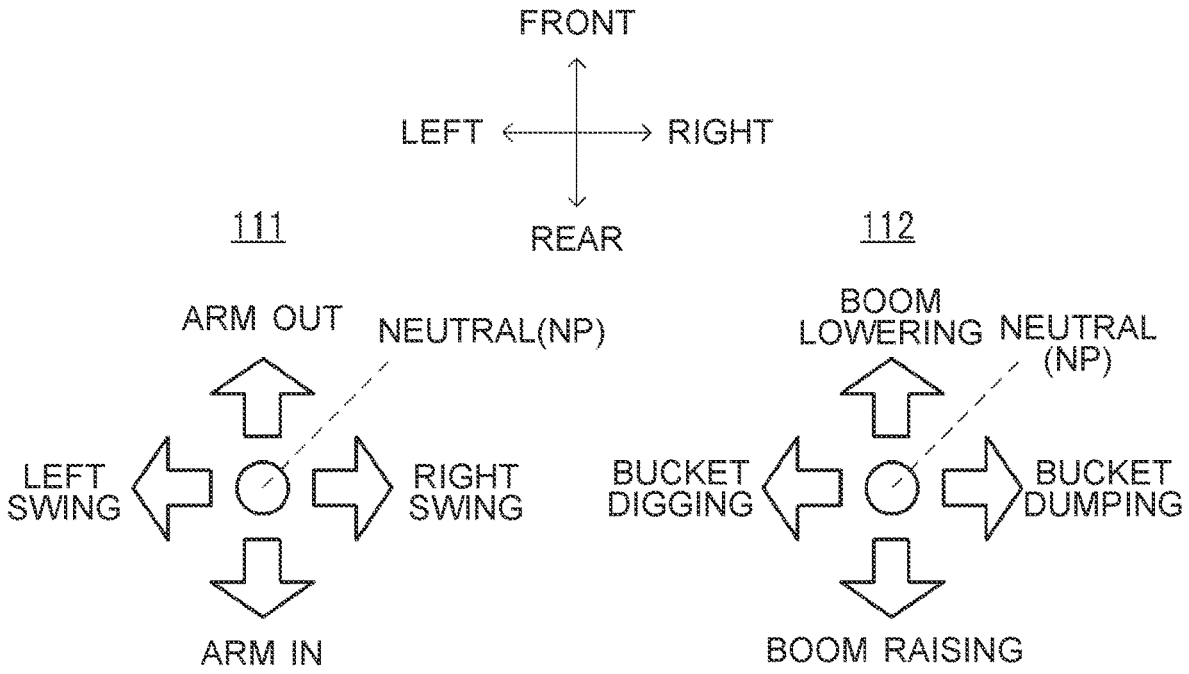
FIG. 3 is an illustration of the operation of a hydraulic excavator in compliance with operation directions of a left operating lever and a right operating lever.

The controller 120 is connected to an operator input sensor 111*d* and an operator input sensor 112*d*, in which the operator input sensor 111*d* outputs signals corresponding to an operation direction and an actual operation angle of an electrical-type left operating lever 111 installed in the cab 107, and the operator input sensor 112*d* outputs signals corresponding to an operation direction and an actual operation angle of an electrical-type right operating lever 112 installed in the cab 107. The actual operation angle (actual operator input) refers to a tilt angle from a neutral position NP of each operating lever 111, 112. The controller 120 receives signals corresponding to operation directions and actual operation angles θ of the left operating lever 111 and the right operating lever 112. The controller 120 functionally includes an operator input detection section 120*d*. The operator input detection section 120*d* detects, based on a signal from each operator input sensor 111*d*, 112*d*, the operation direction and actual operation angle θ of each of the left operating lever 111 and the right operating lever 112. FIG. 3 is an illustration of the operation of the hydraulic excavator 100 in compliance with the operation directions of the left operating lever 111 and the right operating lever 112. The left operating lever 111 is situated on the left side of the driver's seat, while the right operating lever 112 is situated on the right side of the driver's seat.

The left operating lever 111 is an operating member for controlling a rotating motion of the arm 105 relative to the boom 104, and a swinging motion of the revolving upperstructure 102. Upon forward tilting of the left operating lever 111 from the neutral position NP, the arm out operation is performed. The arm out operation refers to the operation in which the arm cylinder 105*a* retracts to cause the arm 105 to rotate (rotate in a clockwise direction in FIG. 1) at a speed in accordance with the actual operation angle in a direction increasing a relative angle of the arm 105 to the boom 104. Upon rearward tilting of the left operating lever 111 from the neutral position NP, the arm in operation is performed. The arm in operation refers to the operation in which the arm cylinder 105*a* extends to cause the arm 105 to rotate (rotate in a counterclockwise direction in FIG. 1) at a speed in accordance with an actual operation angle such that the arm 105 is folded toward the boom 104.

Upon leftward tilting of the left operating lever 111 from the neutral position NP, a swing motor (not shown) is driven, so that the revolving upperstructure 102 swings leftward at a speed in accordance with the actual operation angle. Upon rightward tilting of the left operating lever 111 from the neutral position NP, the swing motor (not shown) is driven, so that the revolving upperstructure 102 swings rightward at a speed in accordance with the actual operation angle.

The right operating lever 112 is an operating member for controlling a rotating motion of the boom 104 relative to the revolving upperstructure 102, and a rotating motion of the bucket 106 relative to the arm 105. Upon forward tilting of the right operating lever 112 from the neutral position NP, the boom lowering operation is performed. The boom lowering operation refers to the operation in which the boom cylinder 104*a* retracts to cause the boom 104 to rotate downward at a speed in accordance with to the actual operation angle. Upon rearward tilting of the right operating lever 112 from the neutral position NP, the boom raising operation is performed. The boom raising operation refers to the operation in which the boom cylinder 104*a* extends to cause the boom 104 to rotate upward at a speed in accordance with an actual operation angle.

Upon leftward tilting of the right operating lever 112 from the neutral position NP, the bucket excavating operation is performed. The bucket excavating operation refers to the operation in which the bucket cylinder 106*a* extends to cause the bucket 106 to rotate (rotate in a counterclockwise direction in FIG. 1) at a speed in accordance with the actual operation angle such that a claw edge (tip) Pb of the bucket 106 moves closer to the ventral surface of the arm 105. Upon rightward tilting of the right operating lever 112 from the neutral position NP, the bucket dumping operation is performed. The bucket dumping operation refers to the operation in which the bucket cylinder 106*a* retracts to cause the bucket 106 to rotate (rotate in a clockwise direction in FIG. 1) at a speed in accordance with an actual operation angle such that the claw edge Pb of the bucket 106 moves away from the ventral surface of the arm 105.

When the left operating lever 111 is tilted from the neutral position NP in an oblique direction such as in an obliquely forward and leftward direction or the like, the arm 105 and the revolving upperstructure 102 are able to be combinedly operated. When the right operating lever 112 is tilted from the neutral position NP in an oblique direction such as in an obliquely forward and leftward direction or the like, the boom 104 and the bucket 106 are able to be combinedly operated. Thus, in the hydraulic excavator 100 according to the embodiment, a concurrent operation of the left operating lever 111 and the right operating lever 112 enables combined performance of four operations at maximum.

As shown in FIG. 2, the controller 120 is connected to a reaction-force applying device 111*r*, and the reaction-force applying device 111*r* produces, for the left operating lever 111, an operation reaction force which is a force opposite to the operation direction of the operator's operation. The controller 120 is also connected to a reaction-force applying device 112*r* that produces, for the right operating lever 112, an operation reaction force which is a force opposite to the operation direction of the operator's operation.

The reaction-force applying device 111*r* and the reaction-force applying device 112*r* have similar configurations, each of which may be configured with an electromagnetic actuator such as a plurality of electromagnetic motors and/or the like. As described later, when control signals indicative of the operation reaction forces decided by the controller 120 are output to the reaction-force applying devices 111*r*, 112*r*, the reaction-force applying devices 111*r*, 112*r* produce the operation reaction forces for the left operating lever 111 and the right operating lever 112.

The controller 120 is connected to a control valve 108. The controller 120 outputs a control signal for controlling the control valve 108 based on the above-described operation directions and actual operation angles of the left operating lever 111 and the right operating lever 112. The control valve 108 is switched in response to the control signal from the controller 120. The control valve 108 controls the flow of pressure oil supplied from a not-shown hydraulic pump to each of actuators (the boom cylinder 104*a*, the arm cylinder 105*a* and the bucket cylinder 106*a*) of the respective front members. Because of this, each front member is driven at a speed in accordance with the actual operation angle for the operation in compliance with the operation directions of the left operating lever 111 and the right operating lever 112.

The controller 120 is connected to a plurality of angle sensors for setting positions of the front members, and the controllers 120 receives signals detected by the respective angle sensors. The plurality of angle sensors includes a boom angle sensor 110*a*, an arm angle sensor 110*b* and a bucket angle sensor 110*c*. The boom angle sensor 110*a* is placed in a junction of the boom 104 and the revolving upperstructure 102, and detects a turning angle of the boom 104 with respect to the revolving upperstructure 102. The arm angle sensor 110*b* is placed in a junction of the boom 104 and the arm 105, and detects a turning angle of the arm 105 with respect to the boom 104. The bucket angle sensor 110*c* is placed in a junction of the arm 105 and the bucket 106, and detects a turning angle of the bucket 106 with respect to the arm 105.

The controller 120 includes an attitude arithmetic section 121, a target trajectory setting section 122, an actual speed arithmetic section 123, a target speed arithmetic section 124, a vector decomposition section 125, a target operator input arithmetic section 126, a reference reaction-force arithmetic section 127, a determination section 128, and a reaction-force correction section 129.

The attitude arithmetic section 121 computes an attitude of the hydraulic excavator 100, that is, the positions of the boom 104, the arm 105 and the bucket 106 which are the front members included in the front working device 103. Data on dimensions of all parts of each front member, the revolving upperstructure 102 and the travel base 101 is stored in the storage device of the controller 120.

The controller 120 uses the dimensions of all parts of the front members and the data detected by the boom angle sensor 110*a*, the arm angle sensor 110*b* and the bucket angle sensor 110*c* to compute positions of preset regions in all the front members including the claw edge Pb of the bucket 106. The dimensions of all parts of the front members include dimensions from the rotation pivot of the boom 104 to the rotation pivot of the arm 105, dimensions from the rotation pivot of the arm 105 to the rotation pivot of the bucket 106, and dimensions from the rotation pivot of the bucket 106 to the claw edge Pb of the bucket 106. The attitude arithmetic section 121 computes a position of the claw edge Pb of the bucket 106 in predetermined control cycles.

In short, in the embodiment, the position of the claw edge Pb of the bucket 106 moving by the plurality of front members being driven is able to be detected from the data from the plurality of angle sensors 110*a*, 110*b*, 110*c* and the data on dimensions of the plurality of front members.

Figure 4:
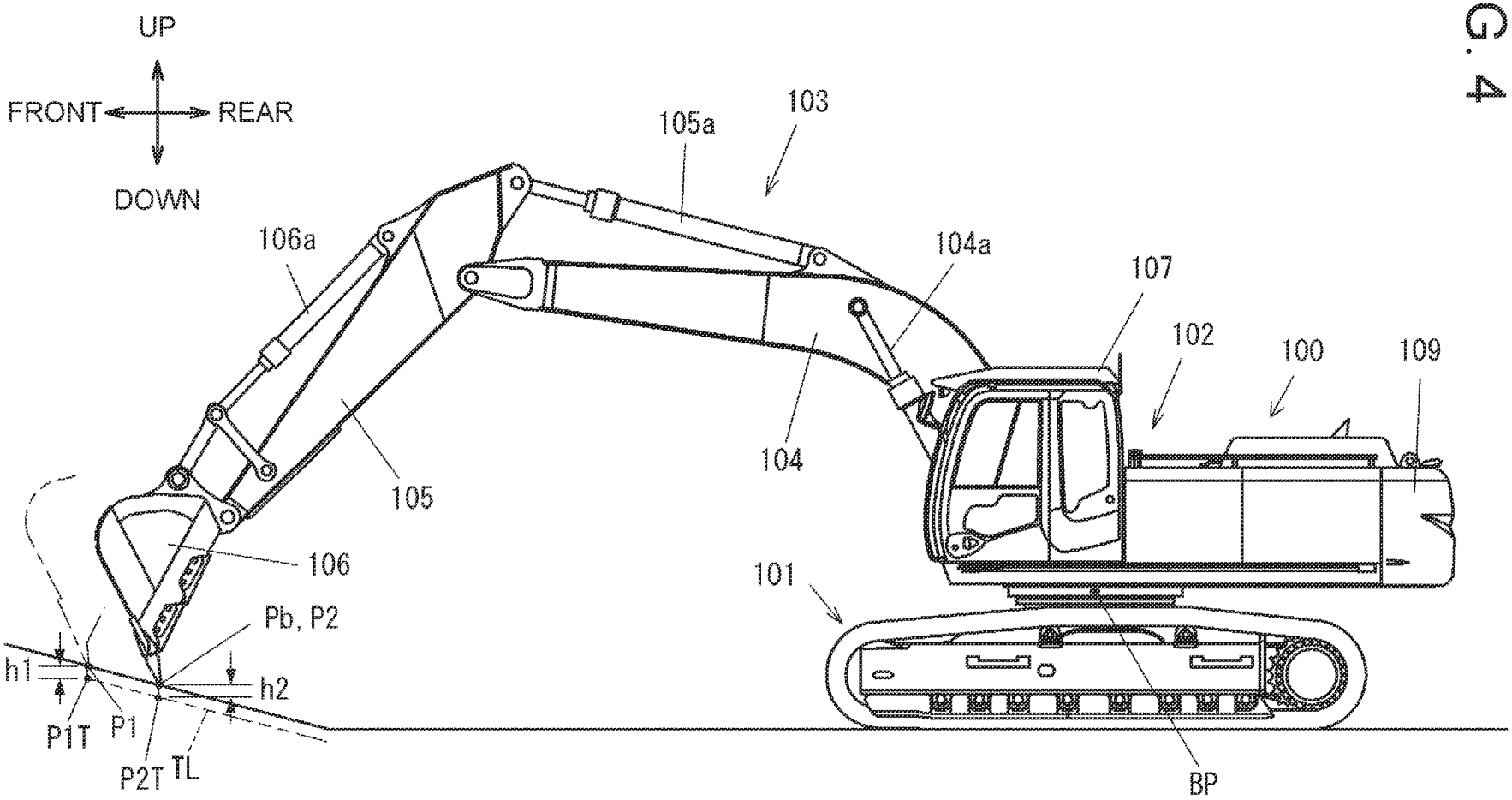
FIG. 4 is a diagram illustrating a method of setting a target trajectory TL.

The target trajectory setting section 122 decides a target trajectory of the claw edge Pb of the bucket 106. Reference is made to FIG. 4 for a description of an example method of setting a target trajectory. FIG. 4 is a diagram illustrating a method of setting a target trajectory TL. As illustrated in FIG. 4, the operator positions the claw edge Pb of the bucket 106 on a first position P1, followed by operating a position setting switch (not shown) and using a depth setting switch (not shown) to input a value of an excavation depth h1. Thus, the target trajectory setting section 122 causes the storage device to store a position at a distance of the excavation depth h1 from the first position P1 toward a downward direction, as a first set point P1T.

The operator positions the claw edge Pb of the bucket 106 on a second position P2 different from the first position P1, followed by operating the position setting switch (not shown) and using the depth setting switch (not shown) to input a value of an excavation depth h2. Thus, the target trajectory setting section 122 causes the storage device to store a position at a distance of the excavation depth h2 from the second position P2 toward a downward direction, as a second set point P2T. It should be noted that the first set point P1T and the second set point P2T are identified by, for example, a horizontal distance from a swing center point BP which is a reference position and a vertical distance from the swing center point BP, which are then stored in the storage device.

The target trajectory setting section 122 calculates a linear equation of a line connecting the first set point P1T located at the depth h1 blow the first pint P1 and the second set P2T located at the depth h2 below the second position P2, and then sets it as a target trajectory TL.

Figure 5:
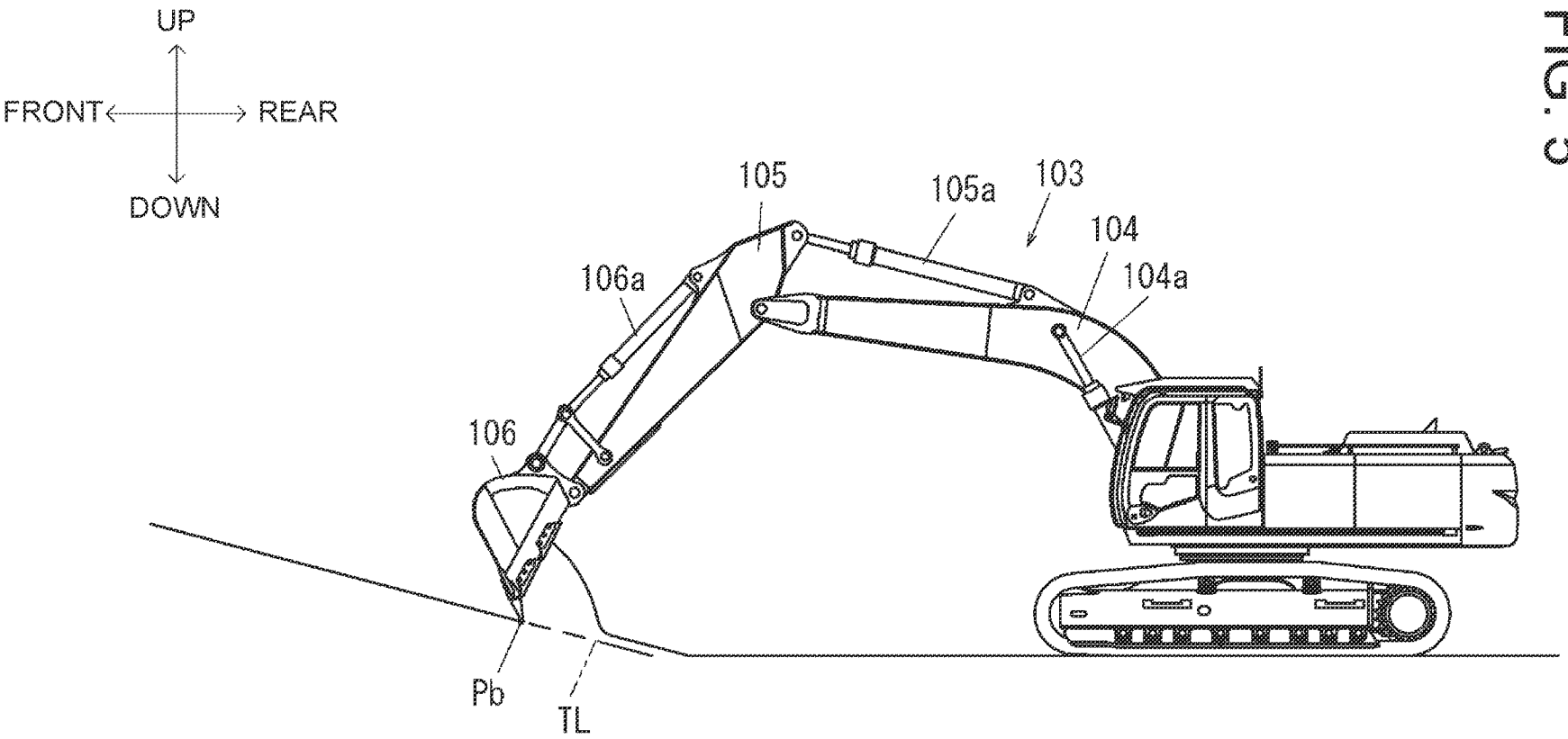
FIG. 5 is a diagram illustrating slope leveling work.

FIG. 5 is a diagram illustrating slope leveling work as an example of the linear excavation work. The slope leveling work illustrated in FIG. 5 can be accomplished by a combination of the arm in operation and the boom raising operation. In the embodiment, if this operation is performed manually, as shown in FIG. 5, reaction-force correction control is executed to prompt the operator for appropriate operation by adjusting the operation reaction forces acting on the left operating lever 111 and the right operating lever 112 such that the claw edge Pb of the bucket 106 is moved along the target trajectory TL. It is noted that, in the embodiment, for convenience in describing, the correction control for the operation reaction force when the manipulation to effect the operation of the bucket 106 and the revolving upperstructure 102 is not performed is described.

Figure 6A:
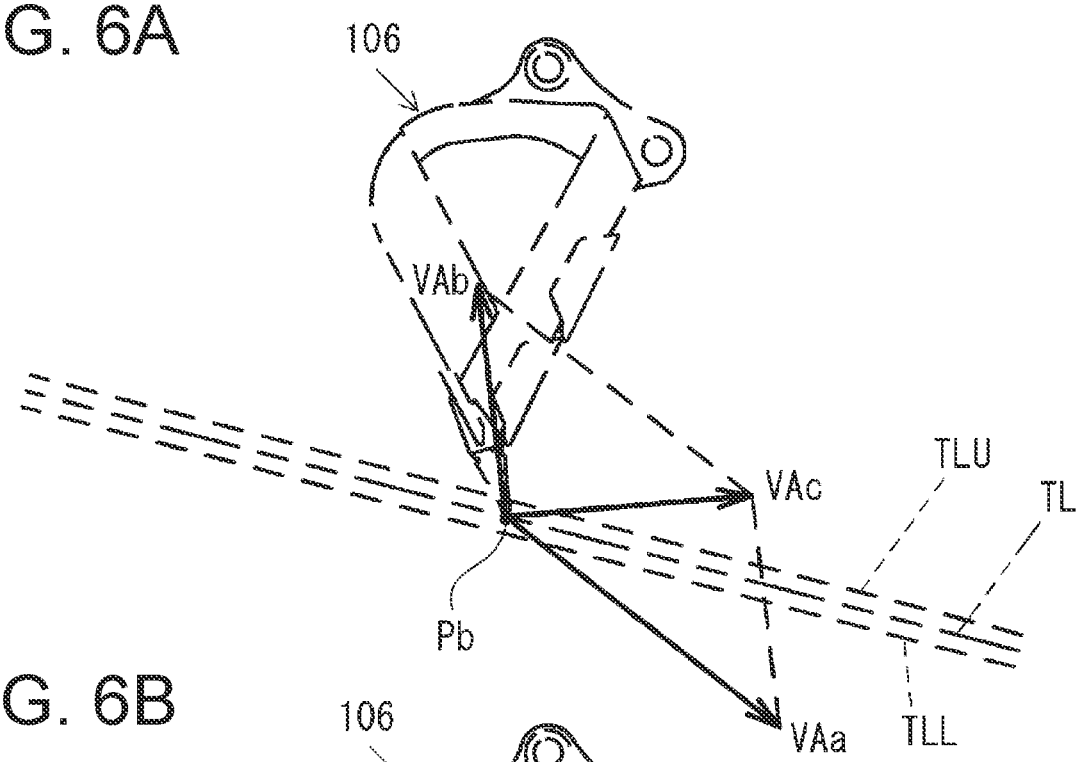
FIG. 6A is a diagram depicting an actual velocity vector VAc of a claw edge Pb.

The actual speed arithmetic section 123 shown in FIG. 2 computes an actual velocity vector VAc of the claw edge Pb. FIG. 6A is a diagram depicting the actual velocity vector VAc of the claw edge Pb. The actual speed arithmetic section 123 computes an actual velocity vector VAc of the claw edge Pb of the bucket 106 on the basis of a difference between a position of the bucket 106 at the time of being computed by the attitude arithmetic section 121 and the position of the bucket 106 which has been computed by the attitude arithmetic section 121 in the preceding control cycle, as well as on the basis of the time from the preceding control cycle.

Figure 6B:
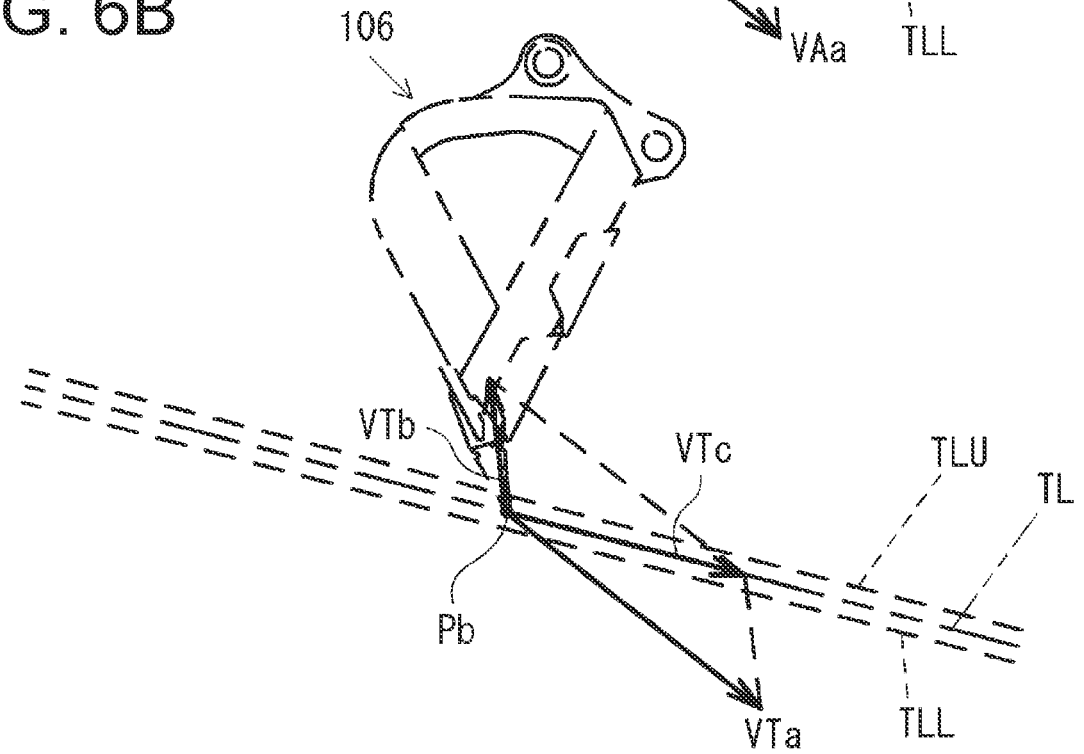
FIG. 6B is a diagram depicting a target velocity vector VTc of the claw edge Pb.

The target speed arithmetic section 124 shown in FIG. 2 decides a target velocity vector VTc of the claw edge Pb to follow the target trajectory TL. FIG. 6B is a diagram depicting the target velocity vector VTc of the claw edge Pb. As illustrated in FIG. 6B, when the claw edge Pb is situated on the target trajectory TL, the direction of the target velocity vector VTc of the claw edge Pb becomes a direction parallel to the target trajectory TL. Also, in the embodiment, the norm of the target velocity vector VTc of the claw edge Pb is set at the same value as that of the norm of the actual velocity vector VAc ($\|VTc\|=\|VAc\|$). In other words, the magnitude of the actual speed of the claw edge Pb is used in place of the magnitude of a target speed.

The vector decomposition section 125 shown in FIG. 2 decomposes the actual velocity vector VAc into an arm velocity vector VAa and a boom velocity vector VAb, as shown in FIG. 6A, on the basis of the attitude of the front working device 103 at this point in time. The vector decomposition section 125 decomposes the target velocity vector VTc into an arm velocity vector VTa and a boom velocity vector VTb, as shown in FIG. 6B, on the basis of the attitude of the front working device 103 at this point in time.

The arm velocity vector VAs, VTa is a velocity vector resulting from the rotating motion of the arm 105 relative to the boom 104, which has a direction perpendicular to the straight line connecting the rotation pivot (the junction with the boom 104) of the arm 105 and the claw edge Pb. The boom velocity vector VAb, VTb is a velocity vector resulting from the rotating motion of the boom 104 relative to the revolving upperstructure 102, which has a direction perpendicular to the straight line connecting the rotation pivot (the junction with the revolving upperstructure 102) of the boom 104 and the claw edge Pb.

The target operator input arithmetic section 126 shown in FIG. 2 divides the norm of the arm velocity vector VTa which is a target value by the norm of the arm velocity vector VAa which is an actual measured value in order to compute a correction factor Ka ($Ka=\|VTa\|/\|VAa\|$). The target operator input arithmetic section 126 divides the norm of the boom velocity vector VTb which is a target value by the norm of the boom velocity vector VAb which is an actual measured value in order to compute a correction factor Kb ($Kb=\|VTb\|/\|VAb\|$).

The correction factor Ka, Kb is a factor corresponding to a difference between an actual operation angle and a target operation angle, and a target operation angle θt is obtained by multiplying an actual operation angle θ by the correction factor Ka, Kb. Specifically, when the correction factor is one, this represents the agreement between the target operation angle θt and the actual operation angle θ. When the correction factor is greater than one, this represents the actual operation angle θ smaller than the target operation angle θt, whereas the correction factor is lower than one, this represents the actual operation angle θ larger than the target operation angle θt.

The target operator input arithmetic section 126 multiplies the actual operation angle θ in a direction of the arm in operation of the left operating lever 111 (hereinafter also referred to as the "actual operation angle θa) by the correction factor Ka to obtain a target operation angle θt ($\theta t=Ka\cdot\theta a$) used to generate an arm velocity vector VTa which is a target. The target operator input arithmetic section 126 multiplies the actual operation angle θ in a direction of the boom raising operation of the right operating lever 112 (hereinafter also referred to as the "actual operation angle θb) by the correction factor Kb to obtain a target operation angle θt ($\theta t=Kb\cdot\theta b$) used to generate an boom velocity vector VTb which is a target.

Figure 7:
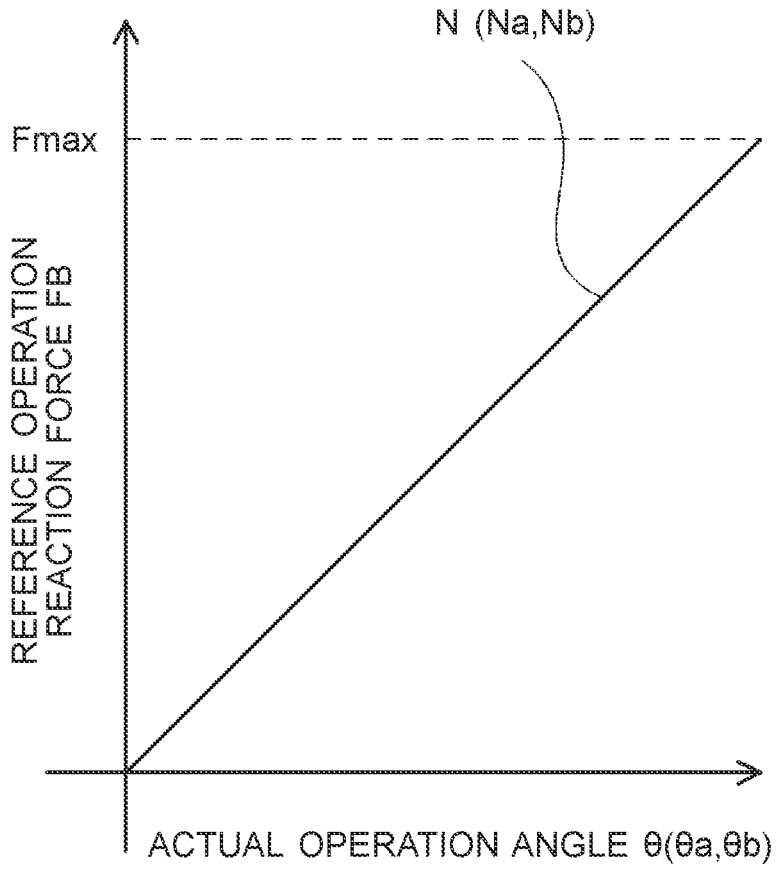
FIG. 7 is a graph showing the relationship between an actual operation angle θ and a reference operation reaction force FB.

The reference reaction-force arithmetic section 127 sets, based on the actual operation angle θ, an operation reaction force F to be generated by the reaction-force applying device 111*r*, 112*r*. FIG. 7 is a graph showing the relationship between the actual operation angle θ and the reference operation reaction force FB. The storage device of the controller 120 stores, in a lookup table form, characteristics Na, Nb of the reference operation reaction forces FB increasing with an increase in the actual operation angles θa, θb of the left operating lever 111 and the right operating lever 112. If the operation reaction force which will be described later is not corrected, the operation reaction forces F depending on the actual operation angles θa, θb according to the characteristics Na, Nb are applied to the operating levers 111, 112 by the reaction-force applying devices 111*r*, 112*r*.

The characteristic Na based on the actual operation angle θa may be identical to or different from the characteristic Nb based on the actual operation angle θb. In the embodiment, assuming that the characteristic Na and the characteristic Nb are identical to each other, the characteristics Na, Nb are collectively referred to as a characteristic N for description and the actual operation angle θa and the actual operation angle θb are collectively referred to as an actual operation angle θ for description. Incidentally, also, the left operating lever 111 and the right operating lever 112 are collectively referred to simply as an operating lever R.

The characteristic N is a characteristic of the reference operation reaction force FB linearly increasing as the actual operation angle θ increases, and a maximum value of the characteristic N is Fmax. When the operating lever R is operated in the front-rear direction, the reference reaction-force arithmetic section 127 makes reference to the characteristic N to compute a reference operation reaction force FB depending on the actual operation angle θ detected by the operator input sensor 111*d*, 112*d*.

The determination section 128 shown in FIG. 2 determines whether the actual operation angle θ of the operating lever R is increased or decreased, or alternatively whether or not a change is made. The determination section 128 performs a comparison between the actual operation angle θ detected by the operator input sensor 111*d*, 112*d* at this point of time and the actual operation angle θ detected by the operator input sensor 111*d*, 112*d* in the preceding control cycle. If the actual operation angle θ at this point of time is greater than the actual operation angle θ in the preceding control cycle, the determination section 128 determines that the actual operation angle θ of the operating lever R increases. If the actual operation angle θ at this point of time is smaller than the actual operation angle θ in the preceding control cycle, the determination section 128 determines that the actual operation angle θ of the operating lever R decreases. If the actual operation angle θ at this point of time is equal to the actual operation angle θ in the preceding control cycle, the determination section 128 determines that a change is not made to the actual operation angle θ of the operating lever R.

The reaction-force correction section 129 makes a correction for the operation reaction force on the basis of the correction factors Ka, Kb. The following is a description of details of correction control executed on the operation reaction force by the reaction-force correction section 129. The correction control of the operation reaction force F for the left operating lever 111 and the correction control of the operation reaction force F for the right operating lever 112 are approximately the same. Therefore, the left operating lever 111 and the right operating lever 112 are correctively referred to as an operating lever R and the correction control of the operation reaction force F for the operating lever R is described. It is noted that the correction factors Ka, Kb are correctively referred to as a correction factor K, and similarly the actual operation angles θa, θb are correctively referred to as an actual operation angle θ as described above.

The reaction-force correction section 129 performs any one of first correction control and second correction control on the basis of a change of the actual operation angle θ of the operating lever R. If the determination section 128 determines a decrease of the actual operation angle θ of the operating lever R, the first correction control is executed. The first correction control is maintained until the determination section 128 determines an increase of the actual operation angle θ of the operating lever R.

If the determination section 128 determines an increase of the actual operation angle θ of the operating lever R, the reaction-force correction section 129 performs the second correction control. The second correction control is maintained until the determination section 128 determines a decrease of the actual operation angle θ of the operating lever R.

First Correction Control (Correction Control of Reaction Force at Decrease in Actual Operation Angle)

The first correction control by the reaction-force correction section 129 is described. The reaction-force correction section 129 determines whether or not the correction factor K is lower than a threshold value β, and also whether or not the correction factor K is equal to or higher than a threshold value α. The threshold value α is a value higher than one, which is pre-stored in the storage device (α>1). The threshold value β is a value lower than one, which is pre-stored in the storage device (β<1).

The threshold value α and the threshold value β are determined in relation to an allowable range of the target trajectory TL. The allowable range is a range between a target trajectory upper limit TLU which is offset upward from the target trajectory TL by a predetermined amount and a target trajectory lower limit TLL which is offset downward from the target trajectory TL by a predetermined amount, as illustrated in FIG. 6. The allowable range is determined in compliance with the required slope precision. It is noted that settings on the allowable range may be configured to be arbitrarily changed by the operator. The distance from the target trajectory TL to the target trajectory upper limit TLU and the distance from the target trajectory TL to the target trajectory lower limit TLL may be set to have different values or the same value.

If it is determined that a difference between an actual operation angle and a target operation angle is large and the correction factor K is lower than the threshold value β, the reaction-force correction section 129 adds a correction amount ΔF to the reference operation reaction force FB to correct the operation reaction force F (F=FB+ΔF). If it is determined that the correction factor K corresponding to a difference between an actual operation angle and a target operation angle is equal to or higher than a preset threshold value β, and also is lower than a preset threshold value α, the reaction-force correction section 129 determines that the actual operation angle θ reaches the target operation angle θt. Upon determination of the actual operation angle θ reaching the target operation angle θt, the reaction-force correction section 129 subtracts the correction amount ΔF from the reference operation reaction force FB to correct the operation reaction force F (F=FB−ΔF). If it is determined that the correction factor K is equal to or higher than the threshold value α, the reaction-force correction section 129 outputs the reference operation reaction force FB as an operation reaction force F in an as-is state without making any correction (F=FB).

Figure 10A:
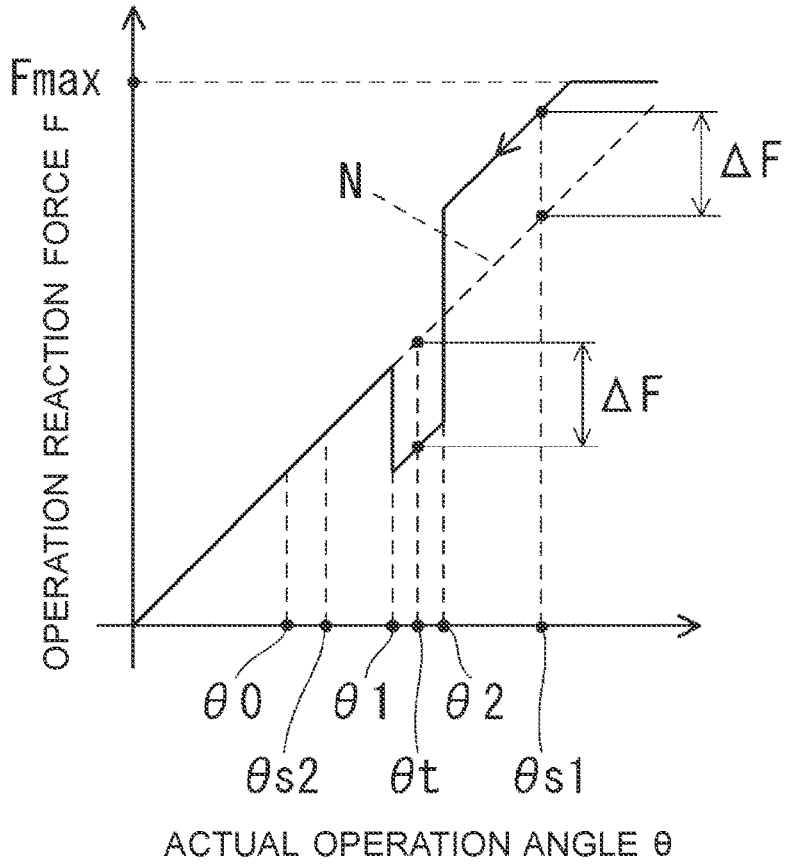
FIG. 10A is graphs showing characteristics of the operation reaction force F produced by a reaction-force applying device in relation to an actual operation angle θ (in case of θ decrease).

It is noted that "θ1" shown in FIG. 10 represents the actual operation angle θ at which the correction factor K reaches the threshold value α, and an operation angle θ2 represent the actual operation angle θ at which the correction factor K reaches the threshold value β. That is, this means that, when the correction factor K is in a range between value β or higher and lower than value α, the actual operation angle θ is within a preset operation range including the target operation angle θt (from θ1 to θ2 in FIG. 10A).

Second Correction Control (Correction Control of Reaction Force at Increase in Actual Operation Angle)

The second correction control by the reaction-force correction section 129 is described. The reaction-force correction section 129 determines whether or not the correction factor K is equal to or higher than a threshold value γ, and also whether or not the correction factor K is lower than the threshold value β. The threshold value γ is a value higher than the threshold value α, which is pre-stored in the storage device (γ>α).

The threshold value γ is set such that the operation reaction force F, which has been corrected to become less than the reference operation reaction force FB determined based on the characteristic N by the correction amount ΔF, has magnitude equal to or greater than that allowing the operating lever R to return to the neutral position NP at least when the operating lever R is not operated. In the embodiment, a lower limit of the actual operation angle θ for performing the correction control of the operation reaction force F corresponds to an operation angle θ0 at which the correction factor K becomes the threshold value γ (see FIG. 10B). Stated another way, when the actual operation angle θ is below the operation angle θ0, the correction control of the operation reaction force F is not executed. An operation reaction force F0 when the actual operation angle θ is the operation angle θ0 is an operation reaction force of such a magnitude or greater that, after the operator releases the operating lever R, the operating lever R can move a mechanical resistance (friction in the joint structure and/or the like) of the operating lever R to return to the neutral position NP.

If it is determined that the correction factor K is equal to or higher than the threshold value γ, the reaction-force correction section 129 outputs the reference operation reaction force FB as an operation reaction force in an as-is state without making any correction (F=FB).

If it is determined that the correction factor K corresponding to a difference between an actual operation angle and a target operation angle is within a range from the preset threshold value β or higher to below the threshold value γ, the reaction-force correction section 129 determines that the actual operation angle θ is within the preset operation range (from θ0 to θ2 in FIG. 10B) including the target operation angle θt. When the actual operation angle θ is determined to fall within the above operation range (from θ0 to θ2 in FIG. 10B), the reaction-force correction section 129 subtracts the correction amount ΔF from the reference operation reaction force FB to correct the operation reaction force F (F=FB−ΔF). If it is determined that the difference between the actual operation angle and the target operation angle is large and the correction factor K is below the threshold value β, the reaction-force correction section 129 adds a correction amount ΔF to the reference operation reaction force FB to correct the operation reaction force F (F=FB+ΔF).

The correction amount ΔF is a positive value, which is pre-stored in the storage device (ΔF>0). It is noted that the correction amount ΔF of the operation reaction force for the left operating lever 111 and the correction amount ΔF of the operation reaction force for the right operating lever 112 may be set as the same value or as different values.

The determination section 128 shown in FIG. 2 determines whether or not the control is executed to correct the reference operation reaction force FB which has been determined based on the characteristic N by the reference reaction-force arithmetic section 127. The determination section 128 draws a line perpendicular to the target trajectory TL down from the position of the claw edge Pb in order to compute the distance from the claw edge Pb to the foot of the perpendicular line (hereinafter referred to as the "perpendicular distance D"). The perpendicular distance D is a difference between the target trajectory TL decided by the target trajectory setting section 122 and the position of the claw edge Pb computed by the attitude arithmetic section 121.

The determination section 128 determines that the correction execution criteria are met when the perpendicular distance D is below a threshold value Dt. The determination section 128 determines that the correction execution criteria are not met when the perpendicular distance D is equal to or greater than the threshold value Dt. The threshold value Dt is arbitrarily set by the operator. For example, if the claw edge Pb is located one meter or more away from the target trajectory TL, the "1 meter" may be preset as a threshold value Dt in order to prevent execution of correction control.

The above-described control of the controller 120 for correction of the operation reaction force is executed when the correction execution criteria are met, but is not executed when the correction execution criteria are not met.

Figure 8:
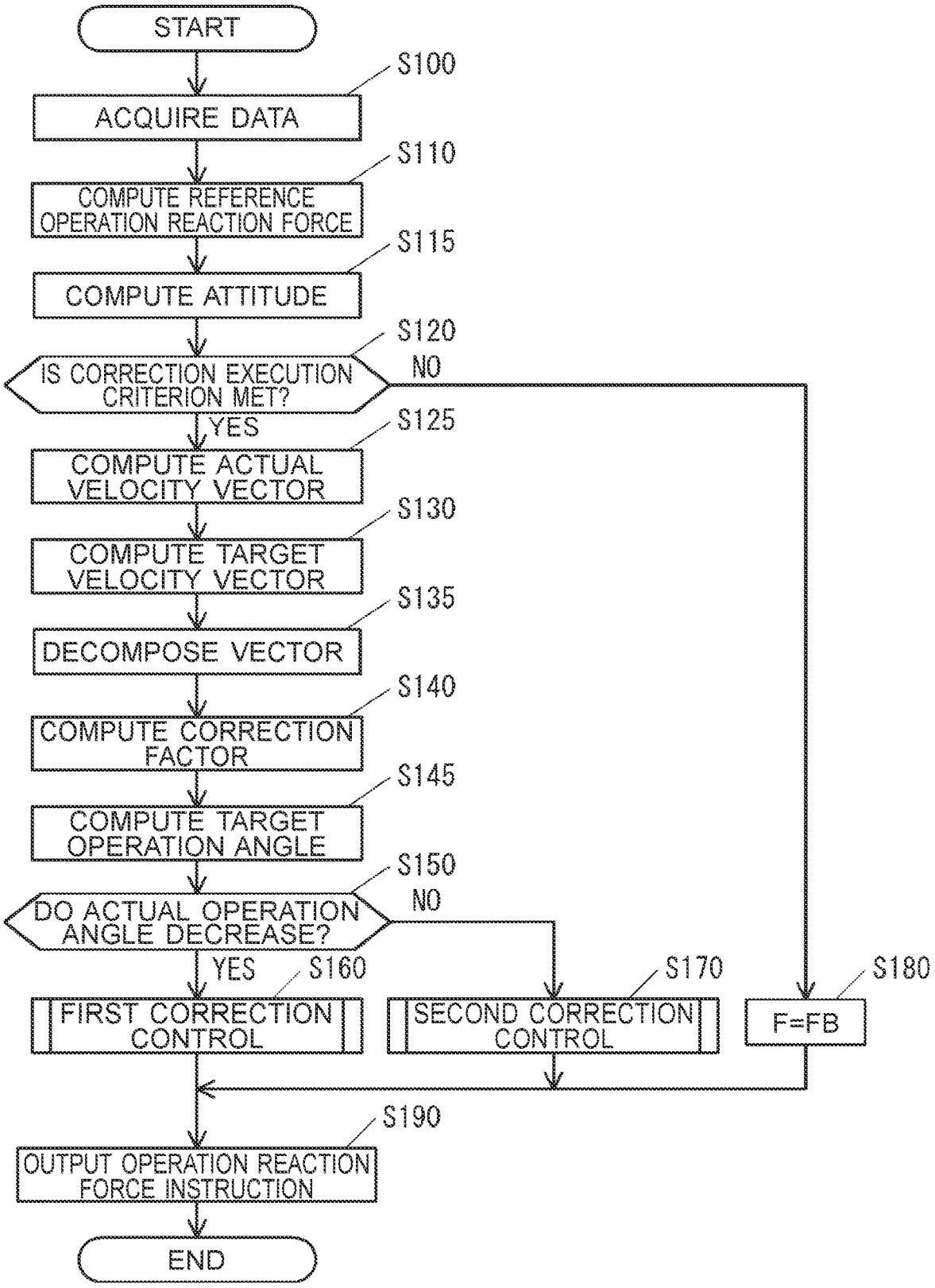
FIG. 8 is a flowchart illustrating example processing by an operation reaction-force control program executed by the controller.

FIGS. 8 and 9 are flowcharts illustrating example processing by the operation reaction force control program executed by the controller 120. FIG. 9 illustrates the details of the first correction control processing and the second correction control processing which are illustrated in FIG. 8. After a target trajectory TL is set based on the operation of the operator, the processing shown in the flowcharts in FIGS. 8 and 9 is started by turning ON an operation guide switch (not shown) connected to the controller 120, and then the processing steps from step S100 onward are repeatedly executed in predetermined control cycles, and eventually the processing is ended by turning OFF the operation guide switch (not shown).

As shown in FIG. 8, at step S100, the controller 120 acquires various kinds of data, and then goes to step S110. The various kinds of data acquired in step S100 include data on a rotation angle of each of the front members detected by the angular sensors 110*a*, 110*b*, 110*c*, and data on actual operation angles θ of the operating levers detected by the operator input sensors 111*d*, 112*d*.

At step S110, the controller 120 looks up the table showing the characteristics N (FIG. 7) stored in the storage device in order to compute a reference operation reaction force FB based on the data on the actual operation angles θ acquired in step S110, and then goes to step S115.

At step S115, the controller 120 computes a work attitude of the hydraulic excavator 100 based on the dimensions of all parts of each front member stored in the storage device and on the data on the rotation angle of each front member acquired in step S100, and then the controller 120 goes to step S120. In the attitude arithmetic processing in step S115, the position of the claw edge Pb of the bucket 106 with respect to the swing center point BP of the revolving upperstructure 102, the position of the rotation pivot of the arm 105 and the position of the rotation pivot of the bucket 106 are computed. In the attitude arithmetic processing in step S115, the perpendicular distance D from the claw edge Pd to the target trajectory TL is computed.

At step S120, the controller 120 determines whether or not the correction execution criteria are met. If an affirmative determination is made in step S120, that is, if it is determined that the perpendicular distance D is less than the threshold value Dt and the correction execution criteria are met, the controller 120 goes to step S125. If a negative determination is made in step S120, that is, if it is determined that the perpendicular distance D is equal to or greater than the threshold value Dt and the correction execution criteria are not met, the controller 120 goes to step S180.

At step S180, the controller 120 decides the reference operation reaction force FB as an operation reaction force F generated without being processed, and then goes to step S190. In short, a correction is not made for the reference operation reflection force.

At step S125, the controller 120 computes an actual velocity vector VAc of the claw edge Pb based on a difference between the position (the position at the present time) of the claw edge Pb computed in step S115 and the position of the claw edge Pb computed in step S115 in the preceding control cycle, and then the controller 120 goes to step S130.

At step S130, the controller 120 computes a target velocity vector VTc based on the target trajectory TL and on the position of the claw edge Pb computed in step S115, and then goes to step S135.

At step S135, the controller 120 executes the vector decomposition processing and then goes to step S140. In the vector decomposition processing, the actual velocity vector VAc is decomposed into an arm velocity vector VAa and a boom velocity vector VAb, based on the actual velocity vector VAc computed in step S125 and the data on the position of each front member computed in step S115. In the vector decomposition processing, the target velocity vector VTc is decomposed into an arm velocity vector VTa and a boom velocity vector VTb, based on the target velocity vector VTc computed in step S130 and the data on the position of each front member computed in step S115.

At step S140, the controller 120 computes a correction factor K (correction factor arithmetic processing) based of an actually measured value and a target value of the arm velocity vector obtained by the decomposition in step S135 as well as an actually measured value and a target value of the boom velocity vector, and then the controller 120 goes to step S145. In the correction factor arithmetic processing, the controller 120 computes a correction factor Ka by dividing the norm of the arm velocity vector VTa (target value) computed in step S135 by the norm of the arm velocity vector VAa (actually measured value) computed in step S135. In the correction factor arithmetic processing, the controller 120 computes a correction factor Kb by dividing the norm of the boom velocity vector VTb (target value) computed in step S135 by the norm of the boom velocity vector VAb (actually measured value) computed in step S135.

In step S145, the controller 120 multiplies the actual operation angle θ (θa and θb) acquired in step S100 by the correction factor K (Ka and Kb) computed in step S140 to obtain a target operation angle θt, and then goes to step S150.

At step S150, the controller 120 determines whether or not lever manipulation is being executed to effect a decrease in the actual operation angle θ. If the actual operation angle θ at the present time is smaller than the actual operation angle θ acquired in step S100 in the preceding control cycle, an affirmative determination is made in step S150 to set an operator input decrease flag, and then the controller 120 goes to step S160.

If the actual operation angle θ at the present time is larger than the actual operation angle θ acquired in step S100 in the preceding control cycle, a negative determination is made in step S150 to clear the operator input decrease flag, and then the controller 120 goes to step S170. At step S150, if there is no difference between the actual operation angle θ at the present time and the actual operation angle θ in the preceding control cycle, it is configured to move to step S160 or step S170 depending on the state of the operator input decrease flag. That is, if the operator input decrease flag is on, moving to step S160 results, whereas if the operator input decrease flag is off, moving to step S170 results.

At step S160, the controller 120 performs the first correction control, and then goes to step S190. At step S170, the controller 120 performs the second correction control, and then goes to step S190.

Figure 9A:
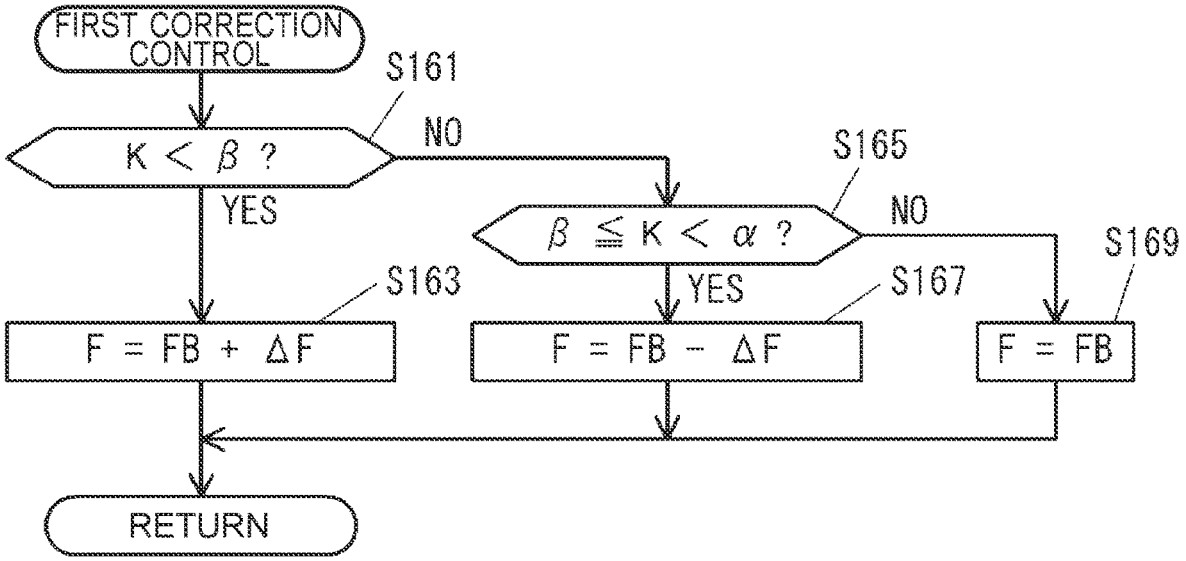
FIG. 9A is flowcharts illustrating examples of first correction control processing of the operation reaction-force control program executed by the controller.

FIG. 9A is a flowchart illustrating the flow of the first correction control processing. As illustrated in FIG. 9A, in the first correction control processing, an operation reaction force F is determined based on the correction factor K computed in step S140 and the threshold value stored in the storage device.

At step S161, the controller 120 determines whether or not the correction factor K is lower than the threshold value β. If an affirmative determination is made in step S161, the controller 120 goes to step S163, whereas if a negative determination is made in step S161, the controller 120 goes to step S165.

At step S165, the controller 120 determines whether or not the correction factor K is equal to or higher than the threshold value β, and lower than the threshold value α. If an affirmative determination is made in step S165, the controller 120 goes to step S167, whereas if a negative determination is made in step S165, the controller 120 goes to step S169.

At step S163, the controller 120 decides, as an operation reaction force F after correction, a value obtained by adding a correction amount ΔF (certain value) stored in the storage device to the reference operation reaction force FB, and then the controller 120 goes to step S190.

At step S167, the controller 120 decides, as an operation reaction force F after correction, a value obtained by subtracting a correction amount ΔF (certain value) stored in the storage device from the reference operation reaction force FB, and then the controller 120 goes to step S190.

At step S169, the controller 120 decides the reference operation reaction force FB as an operation reaction force F generated without being processed, and then goes to step S190. In short, a correction is not made for the reference operation reflection force.

Figure 9B:
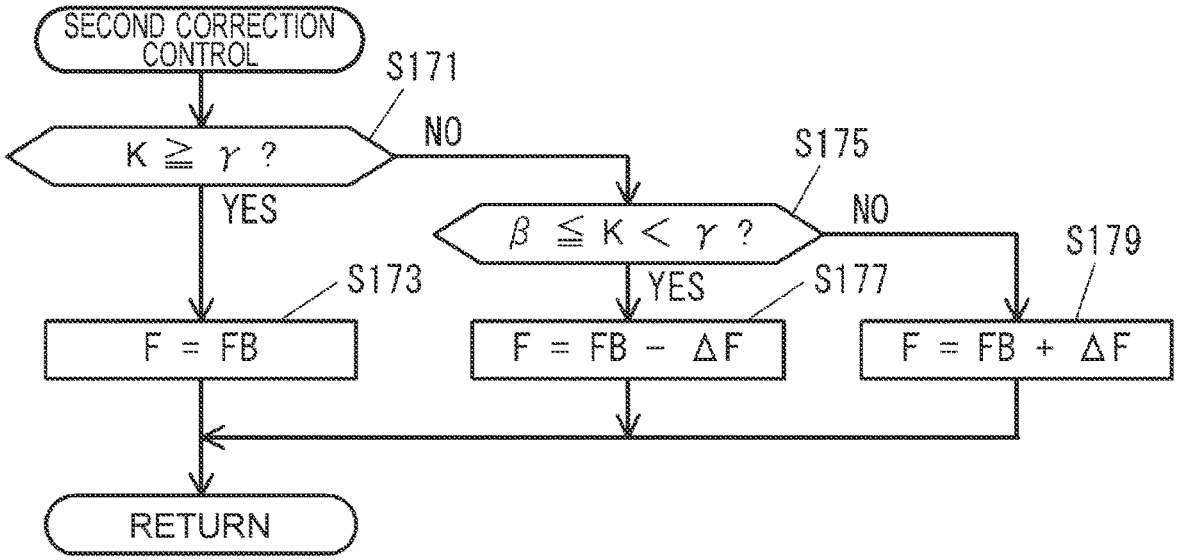
FIG. 9B is flowcharts illustrating examples of second correction control processing of the operation reaction-force control program executed by the controller.

FIG. 9B is a flowchart illustrating the flow of the second correction control processing. As shown in FIG. 9B, in the second correction control processing, an operation reaction force F is determined based on the correction factor K computed in Step S140 and the threshold stored in the storage device.

At step S171, the controller 120 determines whether or not the correction factor K is higher than the threshold value γ. If an affirmative determination is made in step S171, the controller 120 goes to step S173, whereas if a negative determination is made in step S171, the controller 120 goes to step S175.

At step S175, the controller 120 determines whether or not the correction factor K is equal to or higher than the threshold value β, and lower than the threshold value γ. If an affirmative determination is made in step S175, the controller 120 goes to step S177, whereas if a negative determination is made in step S175, the controller 120 goes to step S179.

At step S173, the controller 120 decides the reference operation reaction force FB as an operation reaction force F generated without being processed, and then goes to step S190. In short, a correction is not made for the reference operation reflection force.

At step S177, the controller 120 decides, as an operation reaction force F after correction, a value obtained by subtracting a correction amount ΔF (certain value) stored in the storage device from the reference operation reaction force FB, and then the controller 120 goes to step S190.

At step S179, the controller 120 decides, as an operation reaction force F after correction, a value obtained by adding a correction amount ΔF (certain value) stored in the storage device to the reference operation reaction force FB, and then the controller 120 goes to step S190.

As illustrated in FIG. 8, at step S190, the controller 120 generates control signals for producing the operation reaction forces F decided in steps S160, S170 and S180, and then outputs the generated control signals to the reaction-force applying devices 111*r*, 112*r*.

Figure 10B:
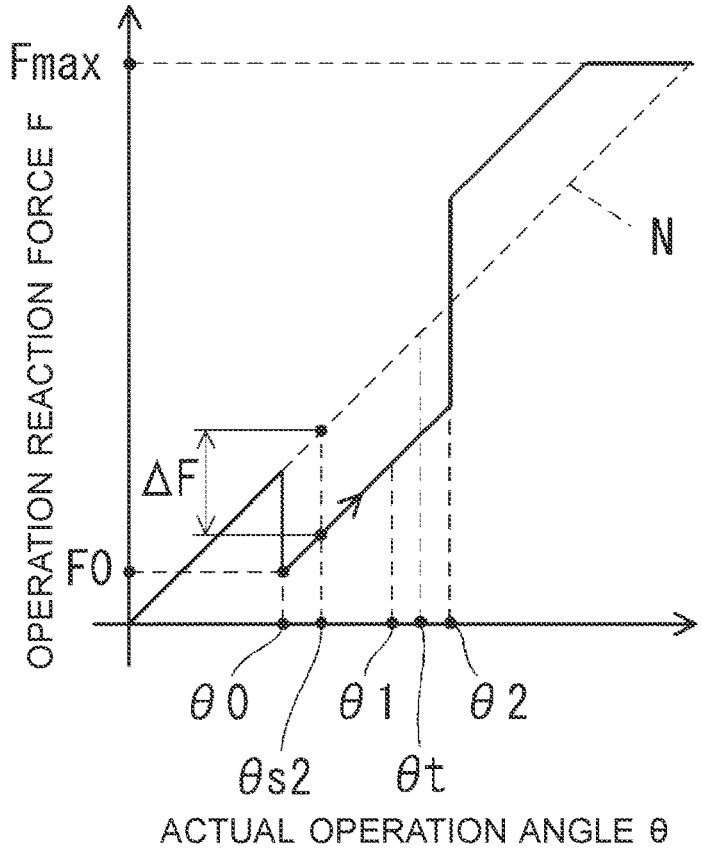
FIG. 10B is graphs showing characteristics of the operation reaction force F produced by a reaction-force applying device in relation to an actual operation angle θ (in case of θ increase).

The following is an overview of basic operation of the hydraulic excavator 100 according to the embodiment provided by using slope leveling work as an example with reference to FIG. 10. FIG. 10 is graphs showing the characteristics of the operation reaction force F produced by the reaction-force applying devices 111*r*, 112*r* in relation to the actual operation angles θ. FIG. 10A shows the characteristics of the operation reaction force F varying according to the actual operation angle θ when lever manipulation is performed to effect a decrease of the actual operation angle θ. FIG. 10B shows the characteristics of the operation reaction force F varying according to the actual operation angle θ when lever manipulation is performed to effect an increase of the actual operation angle θ. In FIGS. 10A and 10B, the horizontal axis represents the actual operation angle θ, and the vertical axis represents the operation reaction force F.

The operator operates both the operating levers 111, 112 to position the claw edge Pb of the bucket 106 on the first position P1 and the second position P2 in this order as illustrated in FIG. 4, and operates the position setting switch (not shown) at the individual positions, and also the operator uses the depth setting switch (not shown) to input values of the excavation depths h1, h2 at the positions of interest. As a result, a target trajectory TL is determined by the controller 120 and then stored in the storage device.

The operator operates both the operating levers 111, 112 to carry out the slope leveling work. Here, as illustrated in FIG. 5, the position of the claw edge Pb of the bucket 106 is positioned on the target trajectory TL and then an operation guide switch (not shown) is operated. As a result, the correction control for the operation reaction force is executed in compliance with the manipulation after the switch operation.

As shown in FIG. 10A, for example, when the operating lever R is operated from the operation angle θs1 to decrease the actual operation angle θ, the first correction control is executed (Yes in step S150, step S160). The operation angle θs1 corresponds to the case where the actual operation angle θ is larger than the target operation angle θt (θt=K·θ), and also the case where a difference between the actual operation angle θ and the target operation angle θt is large (Yes in step S161). It is noted that when each of the actual operation angles θ of the respective operating levers 111, 112 is larger than the target operation angle θt, ||VAa||>||VTa||, ||VAb||>||VTb|| result as illustrated in FIG. 6.

In this case, as shown in FIG. 10A, the operation reaction force F is corrected to become ΔF greater than the reference operation reaction force FB determined based on the characteristics N (step S163). This causes the operator to feel a stronger operation reaction force than usual.

By feeling a strong operation reaction force, the operator can know that the actual operation angle θ is too large as compared with the target operation angle θt. Thus, upon the operator operating the operating levers 111, 112 to decrease the actual operation angle θ, the operation reaction force F gradually decreases as the actual operation angle θ decreases as shown in FIG. 10A.

When the actual operation angle θ decreases beyond an operation angle θ2 close to the target operation angle θt (No in step S161, Yes in step S165), the operation reaction force F is corrected to become ΔF less than the reference operation reaction force FB determined based on the characteristics N (step S167). Note that the operation angle θ2 is an operation angle at which the correction factor K is equal to the threshold value β.

By discontinuously feeling a decrease of the operation reaction force F, the operator can know that the actual operation angle θ approaches the target operation angle θt. This causes the operator to maintain the operating lever R so that the actual operation angle θ is not changed.

Note that, as a result of the operation of the operating lever R to decrease the actual operation angle θ to be smaller than the target operation angle θt, when the actual operation angle θ decreases beyond an operation angle θ1 close to the target operation angle θt (No in step S161, No in step S165), the operation reaction force F becomes the reference operation reaction force FB determined by the characteristics N (step S169). Note that the operation angle θ1 is an operation angle at which the correction factor K is equal to the threshold value α.

By discontinuously feeling an increase of the operation reaction force F, the operator can know that the actual operation angle θ has decreased beyond the target operation angle θt to be too small. Because of this, the operator moves the operating lever R back to cause the actual operation angle θ to approach the target operation angle θt.

On the other hand, as shown in FIG. 10B, for example, when the operating lever R is operated from the operation angle θs2 to increase the actual operation angle θ, the second correction control is executed (No in step S150, step S170). The operation angle θs2 corresponds to the case where the actual operation angle θ is smaller than the target operation angle θt, and also the case where a difference between the actual operation angle θ and the target operation angle θt is within the preset range (equal to or greater than β and less than γ) (No in step S171, Yes in step S175). It is noted that, although not shown, when each of the actual operation angles θ of the respective operating levers 111, 112 is smaller than the target operation angle θt, ||VAa||<||VTa||, ||VAb||<||VTb|| result.

In this case, as shown in FIG. 10B, the operation reaction force F is corrected to become ΔF less than the reference operation reaction force FB determined based on the characteristics N (step S177). This causes the operator to feel a weaker operation reaction force than usual.

By feeling a weak operation reaction force, the operator can know that the actual operation angle θ is too small as compared with the target operation angle θt. Thus, upon the operator operating the operating lever R to increase the actual operation angle θ, the operation reaction force F gradually increases as the actual operation angle θ increases as shown in FIG. 10B.

When the actual operation angle θ increases beyond an operation angle θ2 close to the target operation angle θt (No in step S171, Yes in step S175), the operation reaction force F is corrected to become ΔF greater than the reference operation reaction force FB determined based on the characteristics N (step S179).

By discontinuously feeling an increase of the operation reaction force F, the operator can know that the actual operation angle θ has increased beyond the target operation angle θt to be too large. Because of this, the operator moves the operating lever R back to cause the actual operation angle θ to approach the target operation angle θt.

Note that, in the operation range from the operation angle θ0 to the operation angle θ1, if the operating lever R is operated to decrease the actual operation angle θ, that is, if the operation to increase the difference between the target operation angle θt and the actual operation angle θ is performed, the control switches from the second correction control to the first correction control (Yes in step S150, S160). This causes the operation reaction force F which has been corrected to decrease to increase discontinuously to return to the reference operation reaction force FB (step S169).

By discontinuously feeling an increase of the operation reaction force F, the operator can know that the operating lever R is being operated to cause the actual operation angle θ to move away from the target operation angle θt, that is, that the ongoing operation is opposite to operation to approach the target. This causes the operator to move the operating lever R back to bring the actual operation angle θ closer to the target operation angle θt.

In this manner, according to the embodiment, adjusting the operation reaction force F enables guiding the operator through the operation to move the position of the claw edge Pb of the bucket 106 along the target trajectory TL.

According to the embodiment described above, the following operational effects can be produced.

(1) When a difference between the target operation angle θt and the actual operation angle θ of the front member exceeds a preset range (i.e., when the correction factor K is lower than β), the controller 120 executes a correction to increase the operation reaction forces to be applied by the reaction-force applying devices 111*r*, 112*r* to the operating levers 111, 112 which operate the actuators 103*a*, 104*a* driving the respective front members. When a difference between the target operation angle θt and the actual operation angle θ of the front member is within a preset range (i.e., when the correction factor K is β or higher and lower than α, or is β or higher and lower than γ), the controller 120 executes a correction to decrease the operation reaction forces to be applied, by the reaction-force applying devices 111*r*, 112*r*, to the operating levers 111, 112 which operate the actuators 103*a*, 104*a* driving the respective front members.

Because of this, when the operator operates the operating levers 111, 112 in a combined manner, the operation can be guided to a proper operation for moving the claw edge Pb of the bucket 106 along the target trajectory TL.

(2) The operation reaction force resulting from the correction to decrease an operation reaction force to be applied by the reaction-force applying devices 111*r*, 112*r* has magnitude equal to or greater than that allowing the operating levers 111, 112 to return to the neutral position NP at least when the operating levers 111, 112 are not operated. Because of this, upon the operator taking his/her hands off the operating levers 111, 112, the operating levers 111, 112 return to the neutral position NP by itself, thus providing enhanced operability. Further, in emergency, moving the operator's hands off the operating levers 111, 112 can prevent continuation of the work.

(3) The controller 120 increases the operation reaction force when the operation to increase the difference between the target operation angle θt and the actual operation angle θ is performed. This allows the operator to feel an increase of the operation reaction force F, whereby the operator can know that the operating lever R is being operated to cause the actual operation angle θ to move away from the target operation angle θt.

(4) The controller 120 determines whether or not the actual operation angle θ is within the preset operation range (θ1 to θ2) including the target operation angle θt. If the actual operation angle θ is determined to be within the preset operation range (θ1 to θ2) including the target operation angle θt, the controller 120 executes a correction to decrease the operation reaction forces to be applied to the operating levers 111, 112 by the reaction-force applying devices 111*r*, 112*r*.

By feeling a decrease of the operation reaction force, the operator can know that the actual operation angle θ approaches the target operation angle θt. This facilitates the operator to carry out proper work along the target trajectory TL.

(5) The correction of the operation reaction force is configured to be executed when a difference (e.g., perpendicular distance) D between the target trajectory TL and the detected position of the claw edge Pb of the bucket 106 is below the preset threshold value Dt, whereas no correction of the operation reaction force is configured to be executed when the difference D between the target trajectory TL and the detected position of the claw edge Pb of the bucket 106 exceeds the preset threshold value Dt. When the claw edge Pb is located significantly away from the target trajectory TL, such as when movement different from movement along the target trajectory TL is required to be executed on purpose, and the like, the correction of the operation reaction force is not executed. Because of this, enhanced operability for executing the different movement is achieved.

(6) It is configured to compute an actual velocity vector VAc of the claw edge Pb of the bucket 106 and to determine the norm of the target velocity vector VTc as a value equal to the norm of the actual velocity vector VAc. That is, the target speed of the claw edge Pb of the bucket 106 is determined as the same value as the magnitude of the actual speed. This enables smooth movement of the claw edge Pb.

(7) Since it is configured to use the operation reaction force to guide the operator through the operation, the operator can more intuitively understand proper operation as compared with image guidance using display screens on a display device or voice guidance using speakers.

It is noted that, in the embodiment, the attitude arithmetic section 121 corresponds to a position detection section, and a part of the function of the reaction-force correction section 129 corresponds to a target reaching determination section.

Modifications as described below fall within the scope of the present invention, and the above embodiment may be combined with one or some of example modifications.

Example Modification 1

A method of correcting an operation reaction force is not limited to the above-described embodiment.

Example Modification 1-1

Figure 11A:
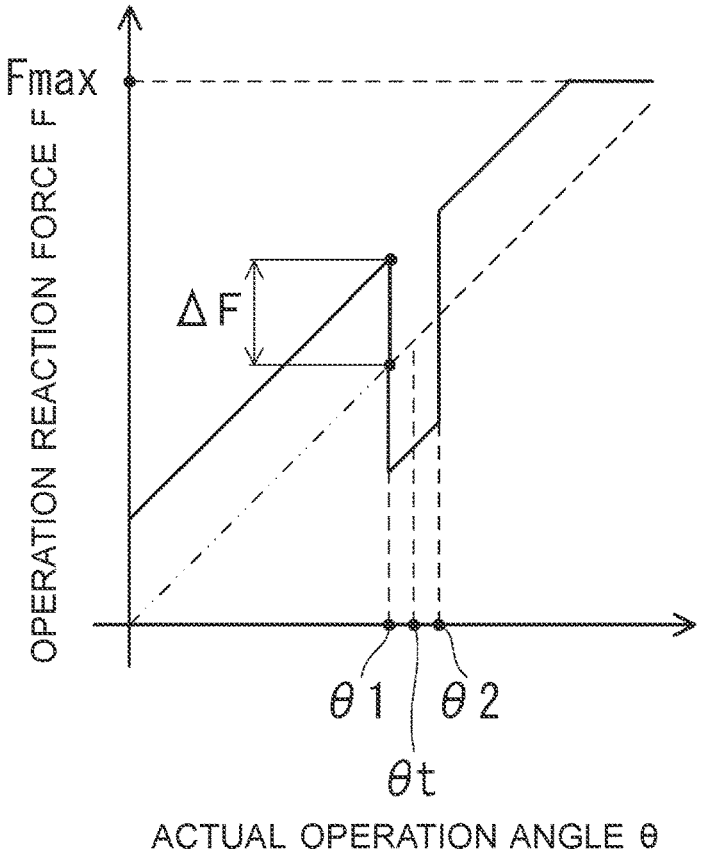
FIG. 11A is graphs illustrating example modifications (example modifications 1-1, 1-2, 1-3) of a method of correcting the operation reaction force (in case of θ decrease).

FIG. 11A is a graph similar to FIG. 10A, which is a graph illustrating an example modification of a method of correcting the operation reaction force. In FIG. 11A, the characteristics of the operation reaction force in the above-described embodiment are indicated by a two-dot chain line. In the above-described embodiment, the characteristics increase the operation reaction force up to the reference operation reaction force FB when the actual operation angle θ decreases to be below the target operation angle θt and reaches the operation angle θ1 in the first correction control.

In contrast to this, in the example modification, when the actual operation angle θ decreases to be below the target operation angle θt and reaches the operation angle θ1, an operation reaction force increased to be ΔF greater than the reference operation reaction force FB is produced. Since the amount of increase in operation reaction force when the operation angle θ1 is reached is larger than the case of the above-described embodiment, the operator can be more clearly aware that the actual operation angle θ has decreased beyond the target operation angle θt.

Example Modification 1-2

Figure 11B:
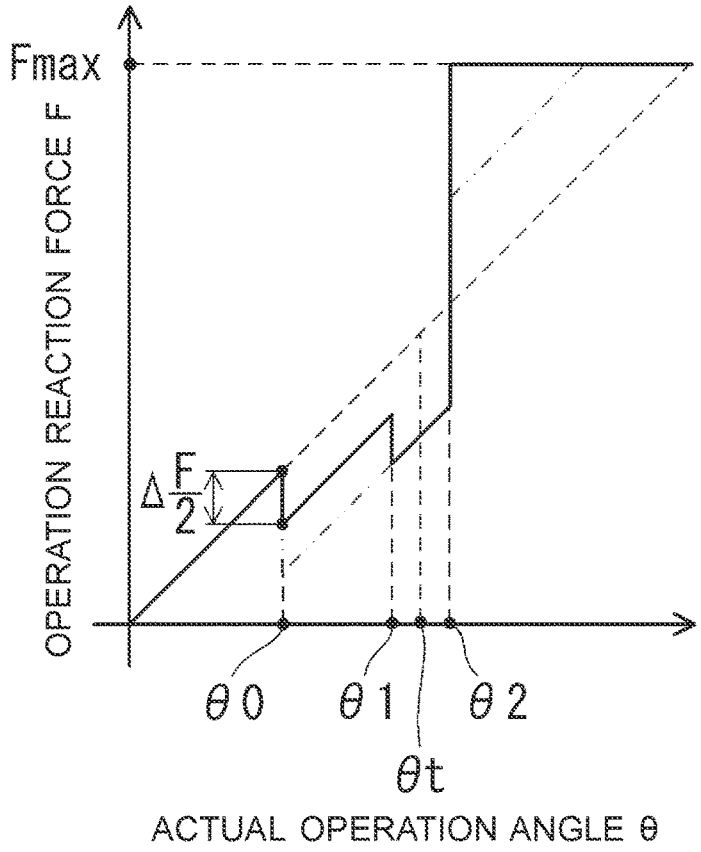
FIG. 11B is graphs illustrating example modifications (example modifications 1-1, 1-2, 1-3) of a method of correcting the operation reaction force (in case of θ increase).

FIG. 11B is a graph similar to FIG. 10B, which is a graph illustrating an example modification of a method of correcting the operation reaction force. In FIG. 11B, the characteristics of the operation reaction force in the above-described embodiment are indicated by a two-dot chain line. In the above-described embodiment, the characteristics produce the operation reaction force that is increased to be greater than the reference operation reaction force FB by the correction amount ΔF, when the actual operation angle θ0 exceeds the target operation angle θt and reaches the operation angle θ2 in the second correction control.

In contrast to this, in the example modification, when the actual operation angle θ exceeds the target operation angle θt and reaches the operation angle θ2, an operation reaction force F is increased up to the maximum value Fmax. Since the amount of increase in operation reaction force when the operation angle θ2 is reached is larger than the case of the above-described embodiment, the operator can be more clearly aware that the actual operation angle θ has increased beyond the target operation angle θt.

Example Modification 1-3

In the above-described embodiment, the characteristics increase the operation reaction force F in a linear manner as the actual operation angle θ increases from the operation angle θ0 toward the target operation angle θt in the second correction control. In contrast to this, in the example modification, as shown in FIG. 11B, characteristics are defined such that the operation reaction force discontinuously decreases when the actual operation angle θ increases from the operation angle θ0 to exceed the operation angle θ1. In the example modification, it is configured to produce, during the operation angles from θ0 to θ1, the operation reaction force F decreased to be less than the reference operation reaction force FB by the correction amount ΔF/2, and to produce, during the operation angles from θ1 to θ2, the operation reaction force F decreased to be less than the reference operation reaction force FB by the correction amount ΔF. In this manner, according to the example modification, even in the operation to increase the actual operation angle θ, as the target operation angle θt approaches, the operation reaction force decreases discontinuously. Because of this, the operator discontinuously feels a decrease of the operation reaction force F, whereby the operator can know that the actual operation angle θ approaches the target operation angle θt.

Example Modification 1-4

Figure 12A:
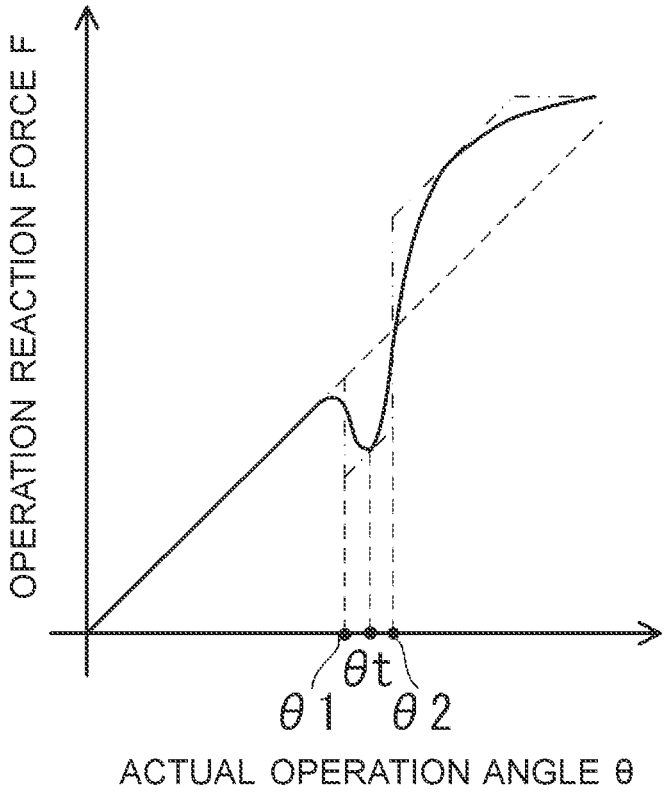
FIG. 12A is graphs illustrating an example modification (example modification 1-4) of a method of correcting the operation reaction force (in case of θ decrease).
Figure 12B:
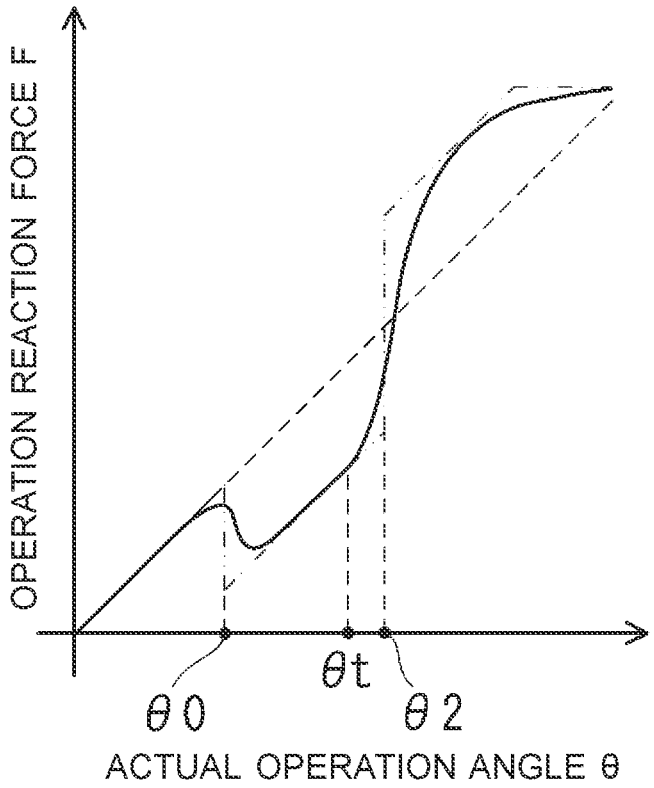
FIG. 12B is graphs illustrating an example modification (example modification 1-4) of a method of correcting the operation reaction force (in case of θ increase).

The example of discontinuously changing the operation reaction force F has been described in the above-described embodiment, but the present invention is not limited to this. For example, as illustrated in FIG. 12A and FIG. 12B, the operation reaction force F may be continuously changed with an increase and a decrease of the actual operation angle θ. In the example of FIG. 12, the correction amount ΔF varies in accordance with the actual operation angle θ. In this case, a ratio (gradient) of the amount of change in the operation reaction force F to the amount of change in the actual operation angle θ may be set such that the operator can be aware of a change in the operation reaction force F.

Example Modification 2

The example that the angle sensors 110*a*, 110*b*, 110*c* detecting a rotation angle of each front member are provided in order to determine the positions of the respective front members has been described in the above-described embodiment, but the present invention is not limited to this. Instead of the angle sensors 110*a*, 110*b*, 110*c*, a stroke sensor may be installed to detect a stroke of a hydraulic cylinder, so that the position of each front member may be determined from the stroke data.

Example Modification 3

The example that the target speed arithmetic section 124 computes a target velocity vector VTc when the claw edge Pb at the present time is on the target trajectory TL has been described in the above-described embodiment, but present invention is not limited to this. When the claw edge Pb at the present time is located away from the target trajectory TL, the target speed arithmetic section 124 computes a transition target trajectory TLt along which the claw edge Pb smoothly moves toward the target trajectory TL, and computes a target velocity vector VTc based on the transition target trajectory TLt.

Example Modification 4

The methods of computing the actual velocity vector VAc, the arm velocity vector VAa and the boom velocity vector VAb are not limited to those in the above-described embodiment. For example, the arm velocity vector VAa may be computed based on the actual operation angle θa of the left operating lever 111, and the boom velocity vector VAb may be computed based on the actual operation angle θb of the right operating lever 112. And then, both vectors may be combined to compute an actual velocity vector VAc.

Example Modification 5

The example that the reaction-force applying devices 111*r*, 112*r* include a plurality of electromagnetic motors has been described in the above-described embodiment, but the present invention is not limited to this. A reaction-force applying device may be configured to include a coil spring and a piston effecting a change in the length of the coil spring. Pressure such as hydraulic pressure, pneumatic pressure and/or the like may be used to produce a reaction force. For example, a reaction-force applying device may be configured to include a reaction-force cylinder and an electromagnetic proportional valve for controlling the driving of the reaction-force cylinder.

Example Modification 6

The example of the left operating lever 111 and the right operating lever 112 being electrical-type operating levers has been described in the above-described embodiment, but the present invention is not limited to this. The present invention may be applied to a hydraulic-pilot type operating lever.

Example Modification 7

The example of slope leveling work being accomplished by combined operation of the boom 104 and the arm 105 has been described in the above-described embodiment, but the present invention is not limited to this. The present invention may be applied to another work such as a horizontal pull and the like. The present invention may also be applied to combined operation of the bucket 106 as well as the boom 104 and the arm 105. In this case, the operation reaction force may be determined in accordance with the angle of inclination of the right operating lever 112 in the left-right directions.

Example Modification 8

The present invention is not limited to the case of ||VAa||>||VTa||, ||VAb>||VTb|| resulting (see FIG. 6), and the case where ||VAa||<||VTa||, ||VAb||<||VTb|| resulting. The present invention is also applicable to the case where

||VAa||>||VTa||, ||VAb<||VTb|| resulting, and the case where ||VAa||<||VTa||, ||VAb||>||VTb|| resulting.

Example Modification 9

The example of the work with movement along the target trajectory TL of the position of the claw edge Pb of the bucket 106 has been described in the above-described embodiment, but the present invention is not limited to this. Instead of the claw edge Pb, for example a position of the rotation center of the bucket 106 may be employed as a preset region of the front working device for determination of a target trajectory. In this case, the present invention may also be applied to the work with movement along the target trajectory TL of the position of the rotation center of the bucket 106.

Example Modification 10

The example of the front working device including the boom 104, the arm 105 and the bucket 106 has been described in the above-described embodiment, but the present invention is not limited to this. The present invention may be applied to a construction machine including a so-called two-piece type front working device that includes a proximal boom rotatably attached to the revolving upperstructure 102, a distal boom rotatably attached to the proximal boom, the arm 105 rotatably attached to the distal boom, and the bucket 106. The present invention can be applied to various types of front working device in which at least two front members or more are combinedly operated along the target trajectory TL.

Example Modification 11

The above embodiment has been described by using the crawler type backhoe as an example, but the present invention is not limited to this. The present invention can be applied to various types of construction machinery including at least two of front members or more being combinedly operated, even if it is, for example, a construction machine that includes a front working device having a plurality of front members including at least two front members or more along the target trajectory TL, such as a loading excavator, a wheeled hydraulic excavator and the like.

Although various embodiments and example modifications have been described, the present invention is not limited to those details. Other aspects contemplated within the scope of the technical idea of the present invention fall within the scope of the present invention.

The entirety of the disclosure of the following Japanese basic patent application is incorporated herein as reference.

Japanese Patent Application No. 2015-178516 (filed Sep. 10, 2015)

REFERENCE SIGNS LIST

100 . . . Hydraulic excavator
101 . . . Travel base
102 . . . Revolving upperstructure
103 . . . Front working device
103*a* . . . Actuator
104 . . . Boom
104*a* . . . Boom cylinder
105 . . . Arm
105*a* . . . Arm cylinder
106 . . . Bucket
106*a* . . . Bucket cylinder
107 . . . Cab
108 . . . Control valve
109 . . . Counterweight
110*a* . . . Boom angle sensor
110*b* . . . Arm angle sensor
110*c* . . . Bucket angle sensor
111 . . . Left operating lever
111*d* . . . Operator input sensor
111*r* . . . Reaction-force applying device
112 . . . Right operating lever
112*d* . . . Operator input sensor
112*r* . . . Reaction-force applying device
120 . . . Controller
120*d* . . . Operator input detection section
121 . . . Attitude arithmetic section
122 . . . Target trajectory setting section
123 . . . Actual speed arithmetic section
124 . . . Target speed arithmetic section
125 . . . Vector decomposition section
126 . . . Target operator input arithmetic section
127 . . . Reference reaction-force arithmetic section
128 . . . Determination section
129 . . . Reaction-force correction section
D . . . Perpendicular distance
F . . . Operation reaction force
BP . . . Swing center point
Dt . . . Threshold value
FB . . . Reference operation reaction force
Ka . . . Correction factor
Kb . . . Correction factor
NP . . . Neutral position
Pb . . . Claw edge
TL . . . Target trajectory
TLL . . . Target trajectory lower limit
TLU . . . Target trajectory upper limit
VAa . . . Arm velocity vector
VAb . . . Boom velocity vector
VAc . . . Actual velocity vector
VTa . . . Arm velocity vector
VTb . . . Boom velocity vector
VTc . . . Target velocity vector

The invention claimed is:

1. A construction machine, including a front working device having a plurality of front members including at least a first front member and a second front member, a plurality of actuators to drive the plurality of front members, and an operating lever for operating the plurality of actuators, the construction machine, comprising:

an operator input sensor that outputs signals corresponding to an actual operator input of the operating lever;

a plurality of angle sensors that detects rotation angles of the plurality of front members;

a reaction-force applying device that produces, for the operating lever, an operation reaction force which is a force opposite to an operation direction of the operating lever; and a controller that is connected to the operator input sensor, the plurality of angle sensors, and the reaction-force applying device, respectively, wherein the controller is configured to:

detect the actual operator input of the operating lever on the basis of the signals output by the operator input sensor;

compute a position of a preset region of the front working device, moving by the plurality of front members being driven, on the basis of the rotation angles detected respectively by the plurality of angle sensors and dimensions of the plurality of front members;

determine a target trajectory of the preset region of the front working device on the basis of the computed position;

determine a target speed of the preset region of the front working device to follow the determined target trajectory;

determine a target operator input of each of at least the first front member and the second front member on the basis of the determined target speed;

when a difference between the determined target operator input of each of at least the first front member and the second front member and the detected actual operator input for the operating lever exceeds a preset range, execute correction to increase the operation reaction force to be produced by the reaction-force applying device for the operating lever; and when the difference is within the preset range, execute correction to decrease the operation reaction force to be produced by the reaction-force applying device for the operating lever.

2. The construction machine according to claim 1, wherein the operation reaction force, resulting from the controller executing the correction to decrease the operation reaction force to be applied by the reaction-force applying device, has a magnitude equal to or greater than that allowing the operating lever to return to a neutral position when the operating unit lever is not operated.

3. The construction machine according to claim 1, wherein when operation is performed to increase a difference between the target operator input and the actual operator input, the controller increases the operation reaction force.

4. The construction machine according to claim 1, wherein the difference between the detected actual operator input and the determined target operator input is within the preset range, the controller executes correction to decrease the operation reaction force to be produced by the reaction-force applying device for the operating lever.

5. The construction machine according to claim 1, wherein the controller is configured, when a difference between the determined target trajectory and the computed position of the preset region of the front working device is below a preset threshold value, to execute the correction of the operation reaction force, and when a difference between the determined target trajectory and the computed position of the preset region of the front working device exceeds a preset threshold value, not to execute the correction of the operation reaction force.

6. The construction machine according to claim 1, wherein the controller is configured to compute an actual speed of the preset region of the front working device, and set a magnitude of the target speed as a value equal to a magnitude of the computed actual speed.

* * * * *